US006531986B2

(12) United States Patent
Saito

(10) Patent No.: US 6,531,986 B2
(45) Date of Patent: Mar. 11, 2003

(54) RETRACTABLE/EXTENDABLE ANTENNA FOR PORTABLE RADIO DEVICE

(75) Inventor: Tetsuya Saito, Saitama (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/834,369

(22) Filed: Apr. 13, 2001

(65) Prior Publication Data

US 2001/0030626 A1 Oct. 18, 2001

(30) Foreign Application Priority Data

Apr. 14, 2000 (JP) ..... 2000-114335
Sep. 19, 2000 (JP) ..... 2000-283346

(51) Int. Cl.[7] ..... H01Q 1/24
(52) U.S. Cl. ..... 343/702; 343/900; 343/901
(58) Field of Search ..... 343/702, 900, 343/901; H01Q 1/24

(56) References Cited

U.S. PATENT DOCUMENTS

| | | | | |
|---|---|---|---|---|
| 5,204,687 A | | 4/1993 | Elliott et al. | 343/702 |
| 5,546,094 A | | 8/1996 | Egashira | 343/702 |
| 5,801,662 A | | 9/1998 | Itoh | 343/702 |
| 5,995,051 A | * | 11/1999 | Sun | 343/702 |
| 5,999,133 A | * | 12/1999 | Svensson | 343/702 |
| 6,011,516 A | * | 1/2000 | Minegishi et al. | 343/702 |
| 6,031,493 A | * | 2/2000 | Tsuda et al. | 343/702 |

FOREIGN PATENT DOCUMENTS

| | | |
|---|---|---|
| EP | 0 516 490 A3 | 12/1992 |
| EP | 0 516 490 A2 | 12/1992 |
| EP | 0 736 925 A3 | 10/1996 |
| EP | 0 736 925 A2 | 10/1996 |
| EP | 0 736 925 B1 | 10/1996 |
| EP | 0 814 536 A3 | 12/1997 |
| EP | 0 814 536 A2 | 12/1997 |
| JP | 9-186519 A | 7/1997 |
| WO | WO 99/22419 | 5/1999 |

* cited by examiner

*Primary Examiner*—Hoanganh Le
(74) *Attorney, Agent, or Firm*—Scully, Scott, Murphy & Presser

(57) ABSTRACT

A retractable/extendable antenna for portable radio device is provided, which expands the bandwidth for the operating frequency of 1.5 GHz. This antenna comprises (a) a casing; (b) a first linear antenna element attached retractably or extendably to the casing; the first element being located outside the casing and fed with electric power to be active in the extended state while located inside the casing and fed with no electric power to be inactive in the retracted state; and (c) a second linear antenna element shorter than the first element, which is connected mechanically to one end of the first element and disconnected electrically therefrom; the second element being located outside the casing and fed with no electric power to be inactive in the extended state while located outside the casing and fed with electric power to be active in the retracted state. The first and second elements may be electrically connected to each other.

14 Claims, 26 Drawing Sheets

RETRACTABLE/EXTENDABLE ANTENNA FOR PORTABLE RADIO DEVICE

BACKGROUND OF THE INVENTION

1. Field of the Invention

The present invention relates to an antenna for wireless mobile communication systems and more particularly, to a retractable or extendable antenna for portable radio device, such as portable information terminals, portable or cellular phones, and so on, which is capable of improving impedance matching in the extended state and the retracted state.

2. Description of the Related Art

Conventionally, there are-several types of antennas for wireless mobile communication systems. An antenna of this type designed for portable radio device such as cellular phones typically has a linear whip element and a helical element fixed to one end of the whip element. The antenna is attached to the casing of the device in such a way that the whip element can be retracted into the casing and can be pulled out therefrom as necessary.

With the conventional portable radio devices having the antenna of this type, when the user operates the device, the whip antenna element is usually extended from the casing to reduce the antenna performance degradation due to the bad effect caused by the user himself or herself (ie., a human body). On the other hand, when the user does not operate the device, the whip element is retracted into the casing to facilitate carrying of the device.

When the antenna is pulled out from the casing, the whip and helical elements are located outside the casing. In this extended state, only the whip element is active and provides the desired antenna operation. On the other hand, when the antenna is pushed into the casing, the whip element is retracted into the casing while the helical element is located outside. In this retracted state, only the helical element is active and provides the desired antenna operation.

An example of the conventional antenna structures of this type is disclosed in the Japanese Non-Examined Patent Publication No. 9-186519 published in 1997 (which corresponds to the Japanese Patent No. 2,692,670 issued in 1999)

FIGS. 1A and 1B show schematically the structure of a prior-art antenna 101 of this type.

The antenna 101, which is mounted slidably on a casing 120, comprises a conductive, linear whip element 106 and a conductive helical (i.e., coil-shaped) element 117.

The whip element 106 is covered with a dielectric protection film 107. A conductive stopper 109 is fixed to the bottom end of the element 106. The stopper 109 prevents the element 106 from being detached from the casing 120 and serves to feed electric power to the element 106 in the extended state. A feeder or feeding part 104 is fixed to the top end of the element 106 by way of a dielectric separator 105. The feeder 104 serves to feed electric power to the element 106 when the element 106 is retracted into the casing 120. The separator 105 serves to separate electrically the helical element 117 from the whip element 106.

The helical element 117, which is covered with a dielectric 102, is fixed to the feeder 104 at its opposite side to the whip element 106. The helical element 117 is electrically disconnected from the whip element 106 with the separator 105.

The antenna 101 is attached slidably to the casing 120 with a conductive support 108. The support 108 is fixed to the casing 120 and is electrically connected to a specific radio circuit (not shown) provided in the casing 120.

When the whip element 106 is pulled out from the casing 120 (i.e., the antenna 101 is in the extended state), as shown in FIG. 1A, both the whip and helical elements 106 and 117 are located outside the casing 120 and at the same time, the stopper 109 is contacted with the support 108. In this state, the whip element 106 is electrically connected to the radio circuit provided in the casing 120 by way of the stopper 109 and the support 108, thereby feeding electric power to the element 106. Thus, the element 106 is activated and performs its operation.

On the other hand, when the whip element 106 is pushed into the casing 120 (i.e., the antenna 101 is in the retracted state), as shown in FIG. 1B, only the helical element 117 is located outside the casing 120 and at the same time, the feeder 104 is contacted with the support 108. In this state, the helical element 117 is electrically connected to the radio circuit provided in the casing 120 by way of the feeder 104 and the support 108, thereby feeding electric power to the element 117. Thus, the element 117 is activated and performs its operation.

As explained above, only the whip element 106 is activated when the antenna 101 is in the extended state while only the helical element 117 is activated in the retracted state. Therefore, impedance matching can be improved in each state. Thus, in recent years, the prior-art antenna 101 has been extensively used for portable radio devices such as cellular phones.

FIG. 2 shows a graph showing the relationship between the bandwidth of the prior-art antenna 101 and the length of the casing 120 in the retracted state. The curves of FIG. 2 indicate the bandwidth values where the return loss is equal to or less than −10 dB. The curves were obtained by numeric calculation under the condition that the resonance frequency of the helical element 117 was set as 800 MHz and 1.5 GHz without changing the shape and size of the element 117.

As seen from FIG. 2, the bandwidth varies as the casing length changes when the operating frequency is 800 MHz. This means that there is a value of the casing length that maximizes the bandwidth. Unlike this, when the operating frequency is 1.5 GHz, the bandwidth is kept approximately constant in spite of change of the casing length. Thus, it is unable to be said that there is a value of the casing length that maximizes the bandwidth. Also, as seen from FIG. 2, the bandwidth for 1.5 GHz is as low as approximately equal to half (½) to one-fifth (⅕) the bandwidth for the 800 MHz.

As described above, with the prior-art antenna 101 shown in FIGS. 1A and 1B, there is a problem that the obtainable bandwidth for the operating frequency of 1.5 GHz is not as wide as desired in the retracted state. In other words, satisfactory impedance matching is not implemented with respect to the helical element 117 that is activated in the retracted state.

SUMMARY OF THE INVENTION

Accordingly, an object of the present invention is to provide a retractable/extendable antenna for portable radio device that expands the bandwidth for the operating frequency of 1.5 GHz.

Another object of the present invention is to provide a retractable/extendable antenna for portable radio device that makes it possible to realize satisfactory impedance matching in both the extended and retracted states.

The above objects together with others not specifically mentioned will become clear to those skilled in the art from the following description.

According to a first aspect of the present invention, a retractable/extendable antenna for portable radio device is provided, which is operable in an extended state and a retracted state. The antenna comprises:

(a) a casing;

(b) a first antenna element attached retractably or extendably to the casing;

the first element being formed by a linear antenna element;

the first element being located outside the casing and fed with electric power to be active in the extended state;

the first element being located inside the casing and fed with no electric power to be inactive in the retracted state; and (c) a second antenna element connected mechanically to one end of the first element and disconnected electrically therefrom;

the second element being formed by a linear antenna element and shorter than the first element;

the second element being located outside the casing and fed with no electric power to be inactive in the extended state;

the second element being located outside the casing and fed with electric power to be active in the retracted state.

With the retractable/extendable antenna according to the first aspect of the invention, the first antenna element is attached retractably or extendably to the casing and at the same time, the second antenna element is connected mechanically to one end of the first element and disconnected electrically therefrom. The first element is formed by a linear antenna element (e.g., a whip element) while the second element is formed by a linear antenna element (e.g., a rod-shaped element) shorter than the first element.

Moreover, the first element is located outside the casing and fed with electric power to be active in the extended state. The first element is located inside the casing and fed with no electric power to be inactive in the retracted state. The second element is located outside the casing and fed with no electric power to be inactive in the extended state. The second element is located outside the casing and fed with electric power to be active in the retracted state.

Accordingly, in the retracted state where the second element is fed with electric power to be active and the first element is inactive, the bandwidth varies conspicuously with the change of the length of the casing at the operating frequency of 1.5 GHz in a similar way to that at the operating frequency of 800 MHz. This means that there is a value of the length of the casing that maximizes the bandwidth in the retracted state even when the operating frequency is 1.5 GHz. As a result, the bandwidth for the operating frequency of 1.5 GHz can be expanded.

For example, the bandwidth for the operating frequency of 1.5 GHz can be expanded to twice as wide as that of the prior-art antenna 101 or greater.

On the other hand, if a proper reactance element is added to the first element by some means, the input impedance of the antenna in the extended state is changed. If another proper reactance element is added to the second element by some means, the input impedance of the antenna in the retracted state is changed Thus, the values of the input impedance of the antenna in the extended and retracted states can be made closer or can be approximately equalized. As a result, satisfactory impedance matching can be realized in both the extended and retracted states.

In a preferred embodiment of the antenna according to the first aspect of the invention, a conductive support fixed to the casing is additionally provided. The first element is contacted with the support in the extended state and fed with electric power by way of the support. The second element is contacted with the support in the retracted state and fed with electric power by way of the support. The support, the first element, and an intervening dielectric constitute a first adjusting capacitor in the extended state. The support, the second element, and an intervening dielectric constitute a second adjusting capacitor in the retracted state.

In another preferred embodiment of the antenna according to the first aspect of the invention, a conductive stopper fixed to bottom of the first element by way of a dielectric is additionally provided. The first element, the stopper, and the intervening dielectric constitute an adjusting capacitor in the extended state.

In still another preferred embodiment of the antenna according to the first aspect of the invention, a dielectric separator is additionally provided to mechanically connect the first element to the second element and electrically disconnect the first element from the second element. The second element, the casing, and the intervening separator constitute an adjusting capacitor in the retracted state.

In a further preferred embodiment of the antenna according to the first aspect of the invention, the first element is designed for being electrically connected to a terminal matching circuit in the retracted state. The terminal matching circuit provides an adjusting reactance element in the retracted state. In this embodiment, there is an additional advantage that an inductor can be realized as the adjusting reactance element.

In this case, it is preferred that a dielectric separator is additionally provided to mechanically connect the first element to the second element and electrically disconnect the first element from the second element The second element, the casing, and the intervening separator constitute an adjusting capacitor in the retracted state. In this embodiment, there is an additional advantage that an inductor can be realized as the adjusting reactance element for the first element in the extended state while the adjusting capacitance is added for the second element in the retracted state. This facilitates improvement of impedance matching in both the extended and retracted states.

In a still further preferred embodiment of the antenna according to the first aspect of the invention, a dielectric stopper fixed to the first element and a conductive piece fixed to a surface of the stopper are additionally provided. The first element, the piece, and the intervening stopper constitute an adjusting capacitor in the extended state.

According to a second aspect of the present invention, another retractable/extendable antenna for portable radio device is provided, which is operable in an extended state and a retracted state. The antenna comprises:

(a) a casing;

(b) a first antenna element attached retractably or extendably to the casing;

the first element being formed by a linear antenna element;

the first element being located outside the casing and fed with electric power to be active in the extended state;

the first element being located inside the casing and inactive in the retracted state; and (c) a second antenna element connected mechanically to one end of the first element and connected electrically to the first element;

the second element being formed by a linear antenna element and shorter than the first element;

the second element being located outside the casing and fed with electric power to be active in the extended state;

the second element being located outside the casing and fed with electric power to be active in the retracted state.

With the retractable/extendable antenna according to the second aspect of the invention, the first antenna element is attached retractably or extendably to the casing and at the same time, the second antenna element is connected mechanically to one end of the first element and connected electrically thereto. The first element is formed by a linear antenna element (e.g., a whip element) while the second element is formed by a linear antenna element (e.g., a rod-shaped element) shorter than the first element.

Moreover, the first element is located outside the casing and fed with electric power to be active in the extended state. The first element is located inside the casing and fed with no electric power to be inactive in the retracted state also. The second element is located outside the casing and fed with electric power to be active in the extended state. The second element is located outside the casing and fed with electric power to be active in the retracted state.

Accordingly, in the retracted state where only the second element is fed with electric power to be active, the bandwidth varies conspicuously with the change of the length of the casing at the operating frequency of 1.5 GHz in a similar way to that at the operating frequency of 800 MHz. This means that there is a value of the length of the casing that maximizes the bandwidth in the retracted state even when the operating frequency is 1.5 GHz. As a result, the bandwidth for the operating frequency of 1.5 GHz can be expanded.

For example, like the above-described antenna of the first aspect, the bandwidth for the operating frequency of 1.5 GHz can be expanded to twice as wide as that of the prior-art antenna 101 or greater.

On the other hand, if a proper impedance or reactance element is added to the combination of the first and second elements by some means, the input impedance of the antenna in the extended state is changed. If another proper impedance or reactance element is added to the combination of the first and second elements by some means, the input impedance of the antenna in the retracted state is changed Thus, the values of the input impedance of the antenna in the extended and retracted states can be made closer or can be approximately equalized. As a result, satisfactory impedance matching can be realized in both the extended and retracted states.

In a preferred embodiment of the antenna according to the second aspect of the invention, the first element is integrated with the second element.

In another preferred embodiment of the antenna according to the second aspect of the invention, the first element is electrically connected to the second element by way of a conductive member. The first and second elements are fed with electric power by way of the member in the retracted state.

In still another preferred embodiment of the antenna according to the second aspect of the invention, a conductive support fixed to the casing is additionally provided. The first element is contacted with the support in the extended state and fed with electric power by way of the support. The second element is contacted with the support in the retracted state and fed with electric power by way of the support. The support, the second element, and an intervening dielectric constitute an adjusting capacitor in the retracted state.

In a further preferred embodiment of the antenna according to the second aspect of the invention, a conductive stopper fixed to bottom of the first element by way of a dielectric is additionally provided. The first element, the stopper, and the intervening dielectric constitute an adjusting capacitor in the extended state.

In a still further preferred embodiment of the antenna according to the second aspect of the invention, the first element is designed for being electrically connected to a terminal matching circuit in the retracted state. The terminal matching circuit provides an adjusting reactance element in the retracted state. In this embodiment, there is an additional advantage that an inductor can be realized as the adjusting reactance element.

In a more further preferred embodiment of the antenna according to the second aspect of the invention, a dielectric stopper fixed to the first element and a conductive piece fixed to a surface of the stopper are additionally provided. The first element, the piece, and the intervening stopper constitute an adjusting capacitor in the retracted state.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1A:
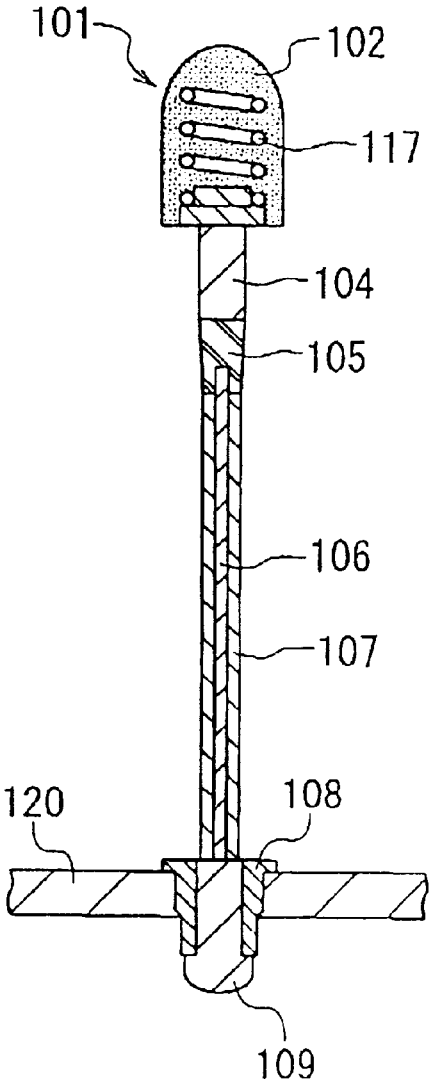
FIG. 1A PRIOR ART
FIG. 1A is a schematic cross-sectional view of a prior-art antenna for portable radio device in the extended state.

Preferred embodiments of the present invention will be described in detail below while referring to the drawings attached.

FIRST EMBODIMENT

Figure 3A:
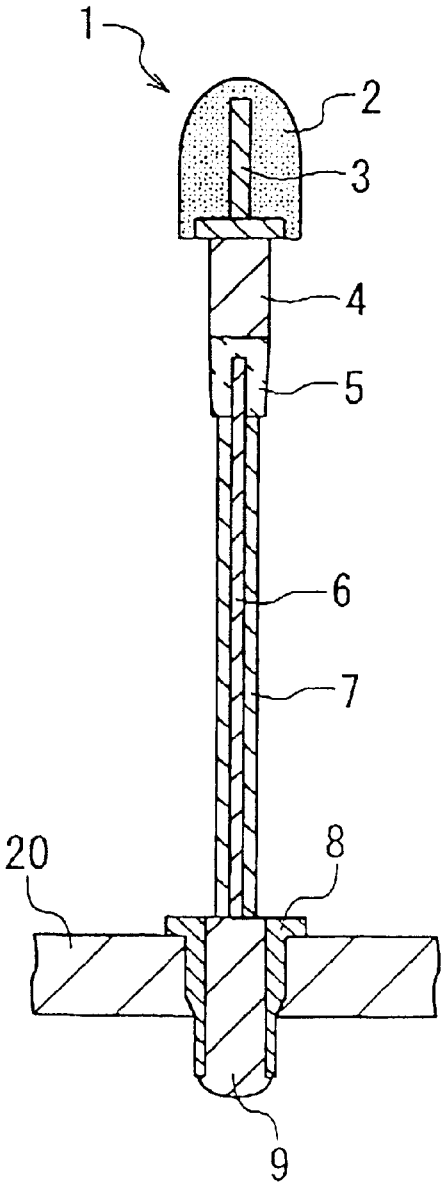
FIG. 3A is a schematic cross-sectional view of an antenna for portable radio device according to a first embodiment of the invention in the extended state.
Figure 3B:
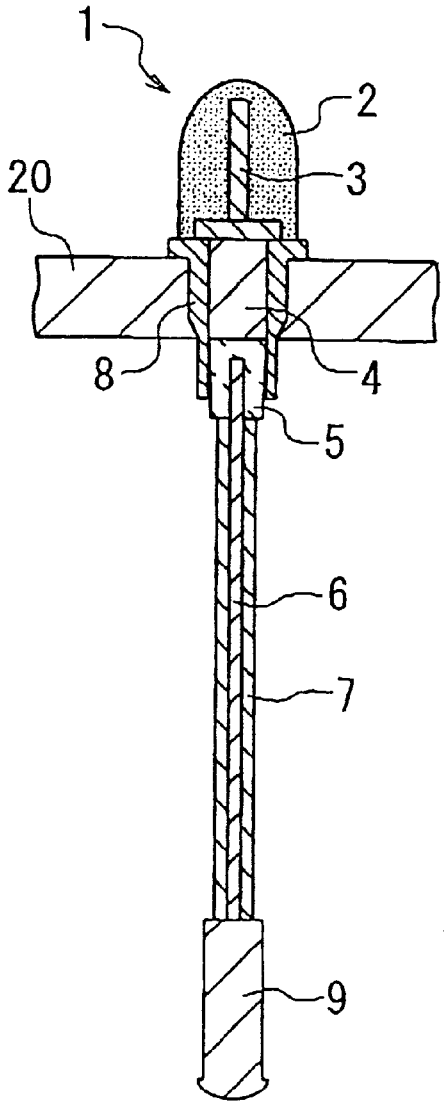
FIG. 3B is a schematic cross-sectional view of the antenna of FIG. 3A in the retracted state.

As shown in FIGS. 3A and 3B, an antenna 1 for portable radio device according to a first embodiment of the invention is attached slidably to a casing 20 by way of a conductive support 8. The support 8, which is fixed to the casing 20, is electrically connected to a specific radio circuit (not shown) provided in the casing 20.

The antenna 1 comprises a conductive, linear whip element 6 and a conductive rod-shaped element 3 that is considerably shorter than the element 6. The whip element 6, which is covered with a dielectric protection film 7, has a conductive stopper 9 fixed to its bottom end. The stopper 9 prevents the antenna 1 from being detached from the casing 20 and serves to feed electric power to the whip element 6 when the antenna 1 is in the extended state.

A dielectric separator 5 is fixed to the top end of the whip element 6. A conductive feeder or feeding part 4 is fixed to the separator 5 at the opposite side of the separator 5 to the element 6. The feeder 4 serves to feed electric power to the rod-shaped or linear element 3 when the antenna l is in the retracted state. The separator 5 serves to electrically separate the rod-shaped element 3 from the whip element 6. The bottom end of the linear element 3 is fixed to the feeder 4 at the opposite side to the element 6. The element 3 is entirely covered with a dielectric material 2.

When the antenna 1 is in the extended state (i.e., the whip element 6 is pulled out from the casing 20), as shown in FIG. 3A, both the whip and linear elements 6 and 3 are located outside the casing 20 and at the same time, the conductive stopper 9 is contacted with the conductive support 8. In this state, the whip element 6 is electrically connected to the radio circuit provided in the casing 20 by way of the stopper 9 and the support 8. Thus, electric power is fed to the element 6 from the radio circuit, which means that only the element 6 is activated and performs its operation.

On the other hand, when the antenna 1 is in the retracted state (i.e., the whip element 6 is pushed into the casing 20), as shown in FIG. 3B, only the linear or rod-shaped element 3 is located outside the casing 20 and at the same time, the conductive feeder 4 is contacted with the conductive support 8. In this state, the element 3 is electrically connected to the radio circuit by way of the feeder 4 and the support 8. Thus, electric power is fed to the element 3 from the radio circuit, which means that only the element 3 is activated and performs its operation.

Figure 1B:
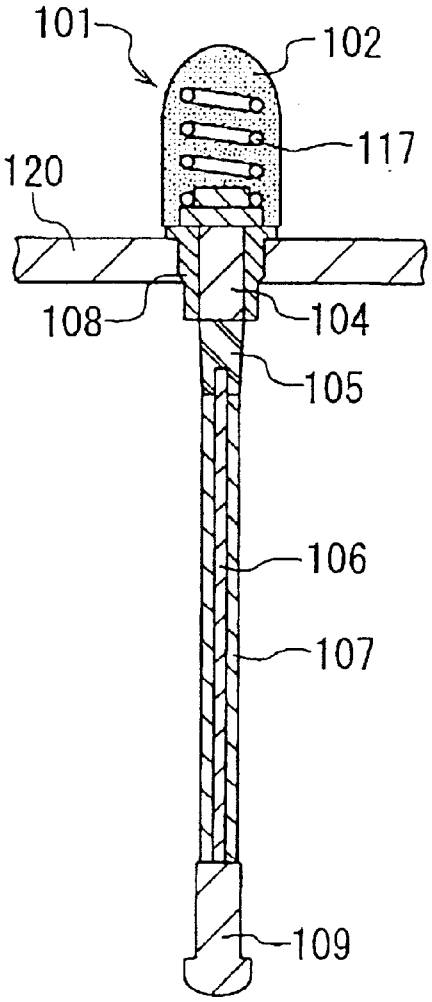
FIG. 1B PRIOR ART
FIG. 1B is a schematic cross-sectional view of the prior-art antenna of FIG. 1A in the retracted state.
Figure 2:
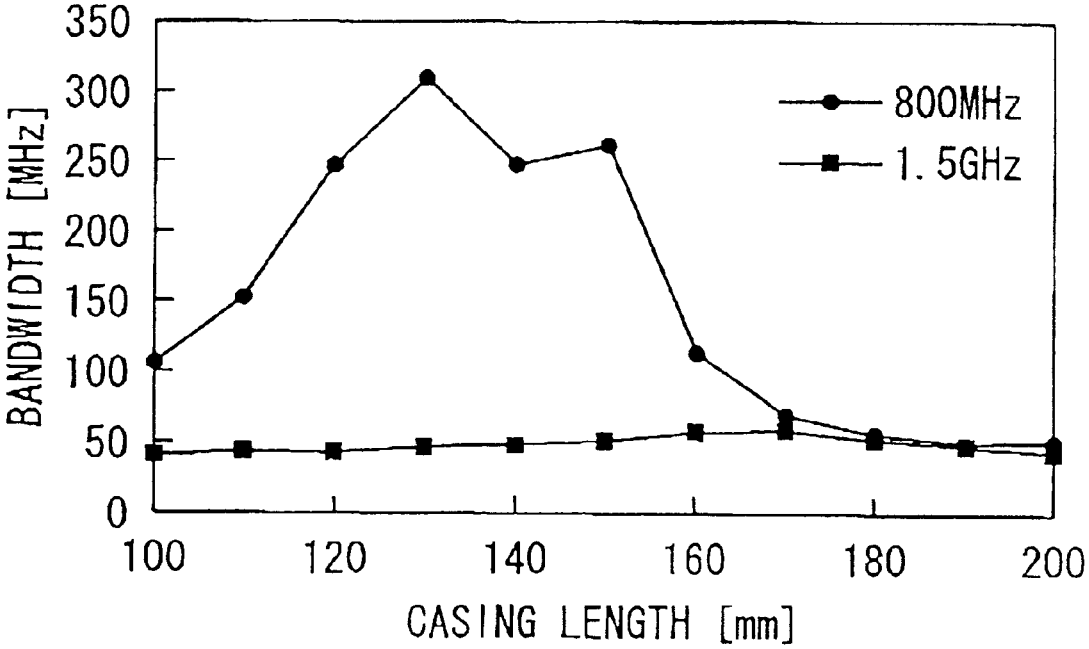
FIG. 2 PRIOR ART
FIG. 2 is a graph showing the relationship between the bandwidth and the casing length of the prior-art antenna of FIGS. 1A and 1B in the retracted state.
Figure 4:
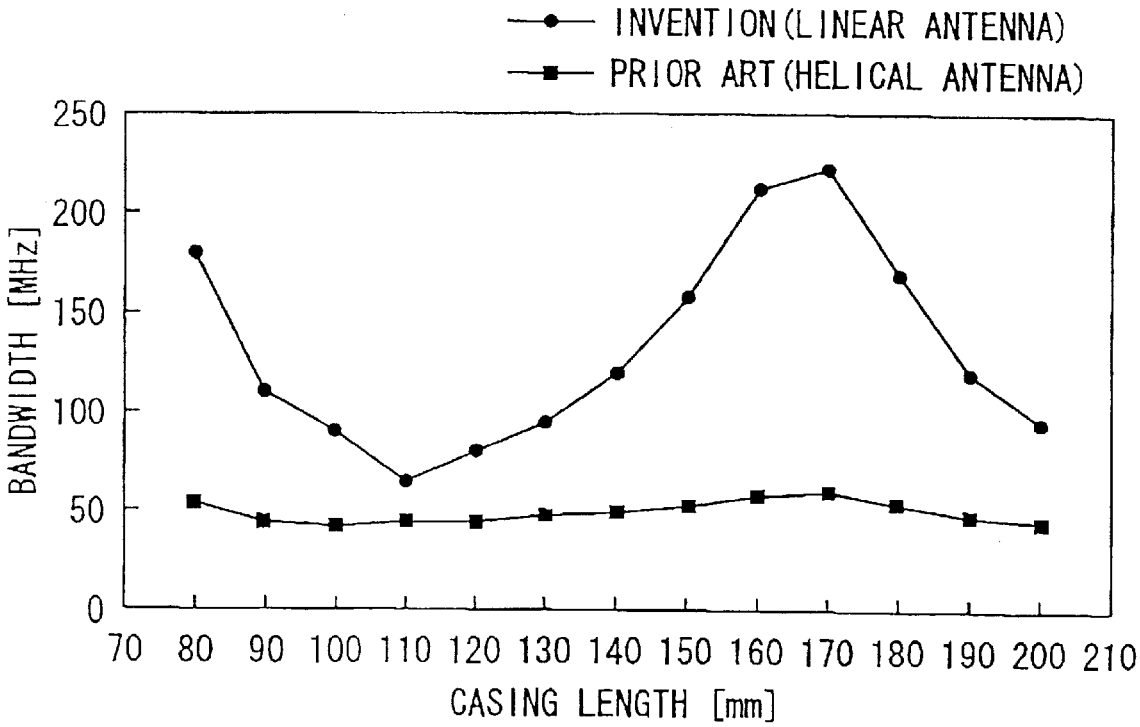
FIG. 4 is a graph showing the relationship between the bandwidth and the casing length of the antenna according to the first embodiment of FIGS. 3A and 3B in the retracted state.

FIG. 4 shows the relationship between the bandwidth of the antenna 1 and the length of the casing 20 according to the first embodiment of FIGS. 3A and 3B in the retracted state. For comparison, the curve of the prior-art antenna 101 shown in FIGS. 1A and 1B is additionally illustrated. These two curves indicate the bandwidth values where the return loss is equal to or less than −10 dB and the operating frequency is set at 1.5 GHz, which were obtained by numeric calculation under the condition that the helical element 117 of the prior-art antenna 101 and the linear element 3 of the antenna 1 of the first embodiment had the same height.

As seen from FIG. 4, with the antenna 1 of the first embodiment including the linear element 3, the bandwidth varies conspicuously as the casing length changes like the operating frequency is set at 800 MHz. This means that there is a value of the casing length that maximizes the bandwidth. Thus, the linear element 3 is active in the retracted state and therefore, there is a possibility that the bandwidth is expanded in the retracted state by adjusting or optimizing the length of the casing 20.

From the inventor's test, it was seen that the bandwidth of the antenna 1 can be expanded to twice as wide as that of the prior-art antenna 101 or greater.

Figure 5:
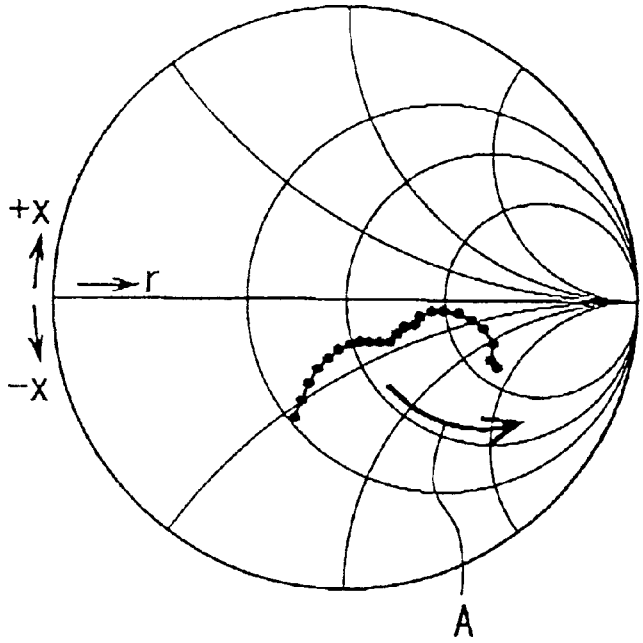
FIG. 5 is a Smith chart showing the input impedance of the antenna according to the first embodiment of FIGS. 3A and 3B in the extended state where the whip element is active.

FIG. 5 is a Smith chart showing the input impedance of the antenna 1 according to the first embodiment in the extended state, in which the dots are plotted in the frequency range near 1.5 GHz. As seen from FIG. 5, the input impedance of the antenna 1 (i.e., the whip element 6) is located in the vicinity of the center of the chart.

Figure 6:
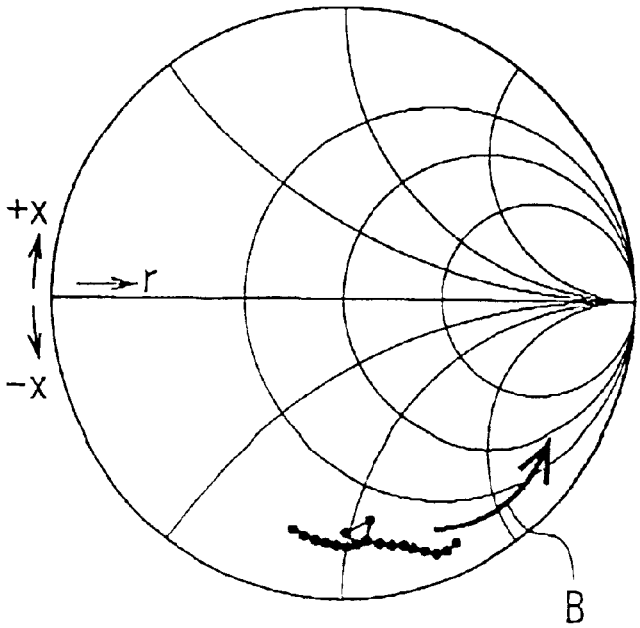
FIG. 6 is a Smith chart showing the input impedance of the antenna according to the first embodiment of FIGS. 3A and 3B in the retracted state where the rod-shaped element is active.

FIG. 6 is a Smith chart showing the input impedance of the antenna 1 according to the first embodiment in the retracted state, in which the dots are plotted in the frequency range near 1.5 GHz 1Like FIG. 6. As seen from FIG. 6, the input impedance of antenna 1 (i.e., the rod-shaped element 3) is located in the periphery of the chart.

Comparing the dots in FIGS. 5 and 6 with each other, it is seen that the input impedance of the antenna 1 in the retracted state includes a lower resistance component and a higher capacitance component than those of the antenna 1 in the extended state. This means that the input impedance values of the antenna 1 in the retracted and extended states do not accord with each other. As a result, desired impedance matching is unable to be realized using the same matching circuit (i.e., without switching the matching circuits).

However, if a proper impedance element is added to the antenna 1 to shift the two groups of the dots along the arrows A and B in FIGS. 5 and 6, respectively, the impedance values of the antenna 1 in the retracted and extended states can be made closer, improving the impedance matching.

Specifically, in the extended state where the whip element 6 is located outside the casing 20, it is preferred that a proper capacitor with a specific capacitance C is added to the antenna 1. In this case, the input impedance value of the antenna 1 is shifted along the arrow A in FIG. 5. On the other hand, in the retracted state where the whip element 6 is retracted into the casing 20, a proper inductor with a specific inductance L is added to the antenna 1. In this case, the input impedance value of the antenna 1 is shifted along the arrow B in FIG. 6.

As a result, it is seen that impedance matching can be improved by adjusting or optimizing the values of the capacitance C and inductance L thus added in the antenna 1 of the first embodiment having the above-described configuration.

SECOND EMBODIMENT

FIGS. 7A and 7B, 8, and 9 show an antenna 1A for portable radio device according to a second embodiment, which has the same configuration as that of the antenna 1 of the first embodiment of FIGS. 3A and 3B except that a dielectric 10 is additionally provided between the whip element 6 and the conductive stopper 9. Therefore, the explanation about the same configuration is omitted here by attaching the same reference symbols as those used in the first embodiment to the same elements or parts in FIGS. 7A and 7B, 8, and 9 for the sake of simplification. The antenna 1A shows a concrete measure that realizes the impedance adjustment as described in the first embodiment.

The dielectric 10 is formed to cover the bottom end of the whip element 6 between the conductive stopper 9 and the whip element 6. The dielectric 10 is mechanically connected to the opposing end of the protection film 7. The dielectric 10 serves to electrically insulate the element 6 from the stopper 9.

Figure 7A:
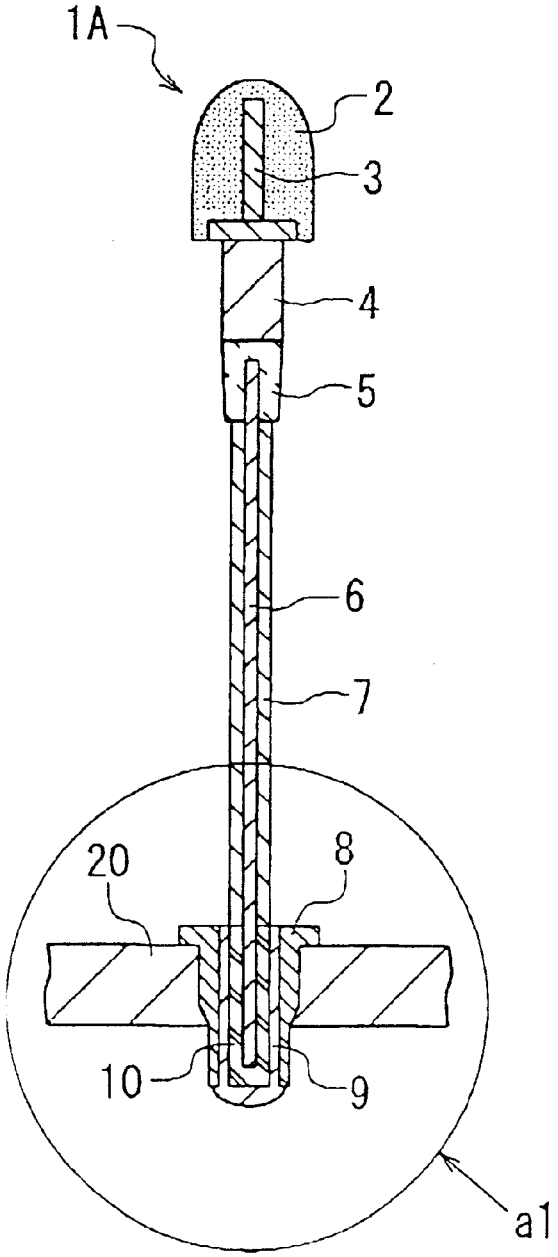
FIG. 7A is a schematic cross-sectional view of an antenna for portable radio device according to a second embodiment of the invention in the extended state.

As seen from FIGS. 7A and B, in the extended state of the antenna 1A, the stopper 9 is contacted with the support 8 and electrically connected thereto, thereby forming an adjusting capacitor 14 by the combination of the stopper 9, the element 6, and the intervening dielectric 10. Thus, the capacitance C of the capacitor 14 is added to the impedance of the element 6. In this case, the electric power is supplied from the radio circuit provided in the casing 20 to the element 6 through the capacitor 14.

The capacitance C of the adjusting capacitor 14 is adjusted by changing the value of at least one of the dielectric constant of the dielectric 10, the distance or interval between the element 6 and the stopper 9, the length of the stopper 9, and the insertion depth of the element 6 into the dielectric 10. Therefore, the value of the capacitance C can be adjusted or optimized easily.

On the other hand, as seen from wigs. 73 and 9, in the retracted state of the antenna 1A, the feeder 4 is contacted with the support 8 and is electrically connected thereto. At the same time as this, the top end of the whip element 6 is inserted into the support 8, thereby coupling capacitively the conductive support 8 and the conductive element 6 together by way of the dielectric separator 5. Thus, an adjusting capacitor 15 is formed at the top end of the element 6.

Fine adjustment is unnecessary for the capacitance value of the adjusting capacitor 15. It is sufficient that the whip element 6 is capacitively coupled with the support 8 to thereby constitute the capacitor 15.

Next, a method of adjusting the input impedance value of the antenna 1A according to the second embodiment is explained below.

Figure 7B:
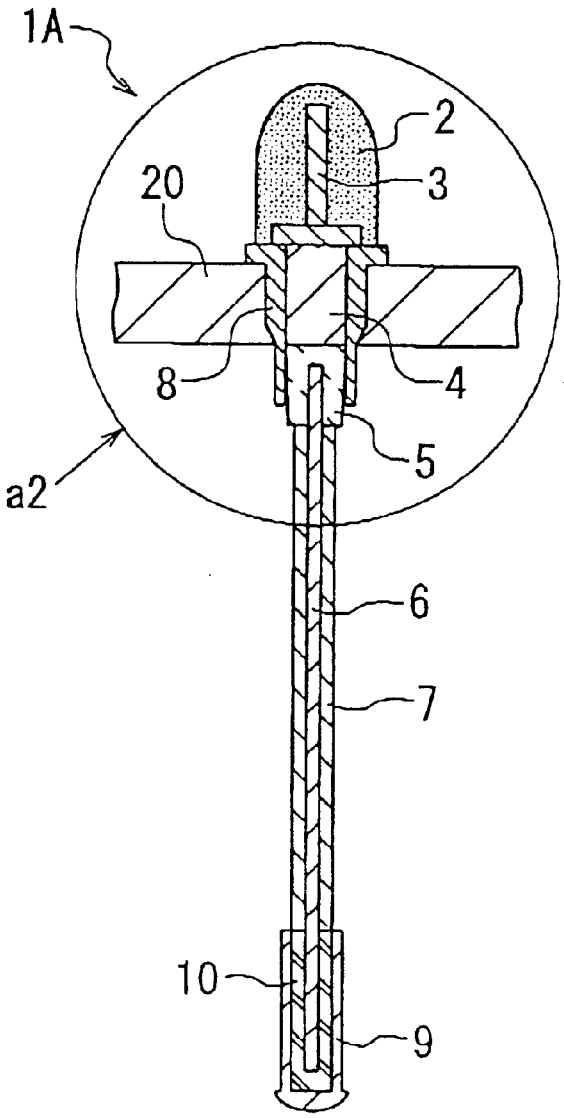
FIG. 7B is a schematic cross-sectional view of the antenna of FIG. 7A in the retracted state.
Figure 8:
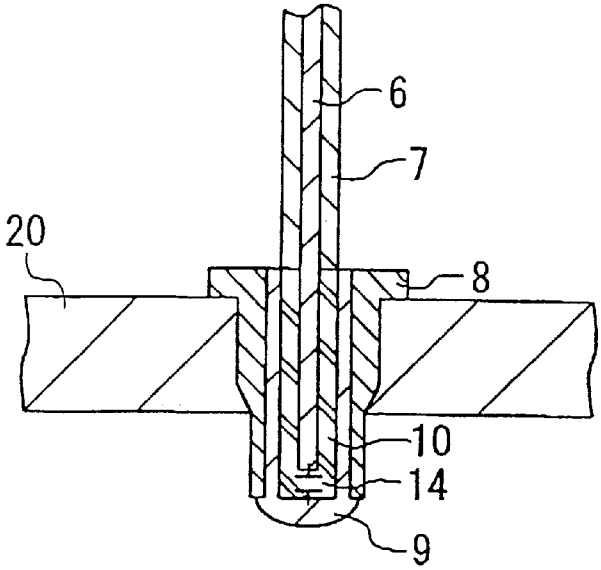
FIG. 8 is an enlarged, partial, schematic cross-sectional view of the area indicated by a1 in FIG. 7A.
Figure 9:
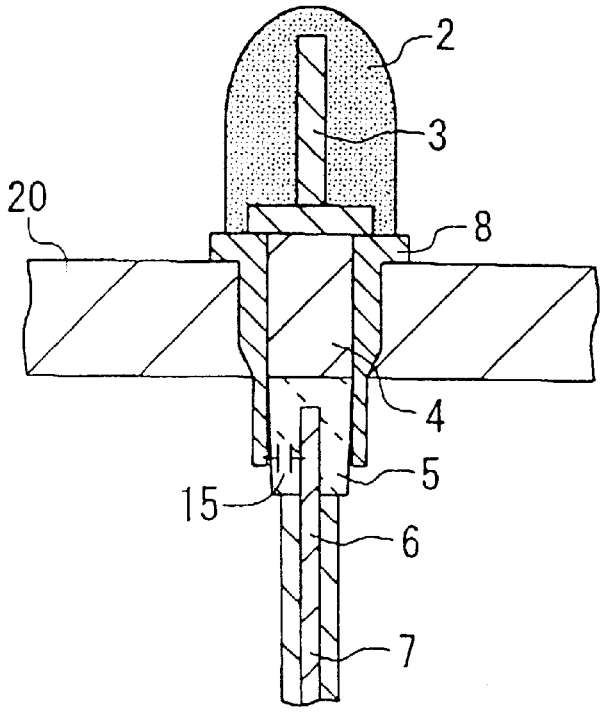
FIG. 9 is an enlarged, partial, schematic cross-sectional view of the area indicated by a2 in FIG. 7B.
Figure 10:
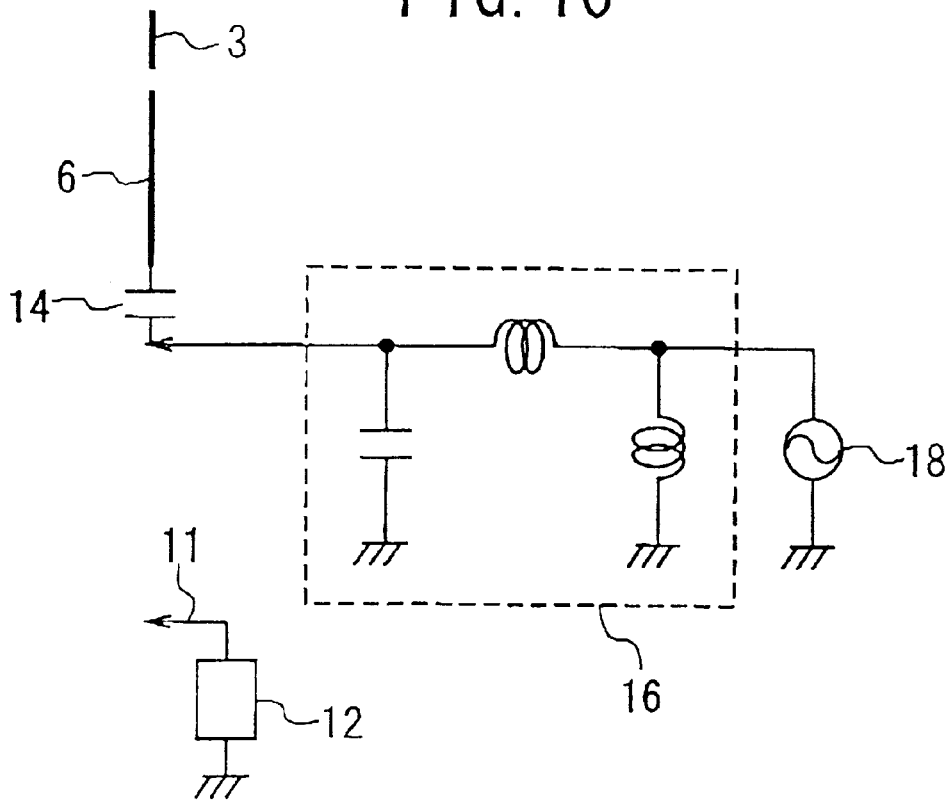
FIG. 10 is a circuit diagram showing the circuit configuration of the antenna according to the second embodiment of FIGS. 7A and 7B in the extended state, where the whip element is connected to the Radio circuit by way of the matching circuit.

FIG. 10 shows the circuit configuration of the antenna 1A according to the second embodiment of FIGS. 7A and 7B in use in the extended state. In this state, the bottom end of the whip element 6 is electrically connected to the stopper 9 by way of the adjusting capacitor 14. Furthermore, the element 6 is electrically connected to the radio circuit 18 by way of the matching circuit 16, where the circuits 18 and 16 are located in the casing 20. No electrical connection is given to the rod-shaped element 3. Thus, the adjusting capacitance C of the capacitor 14 is added to the impedance of the element 6, which adjusts or optimizes the overall input impedance of the antenna 1A and its relating circuits. The matching circuit 16 is usually comprised of at least one capacitor and at least one inductor.

Figure 11:
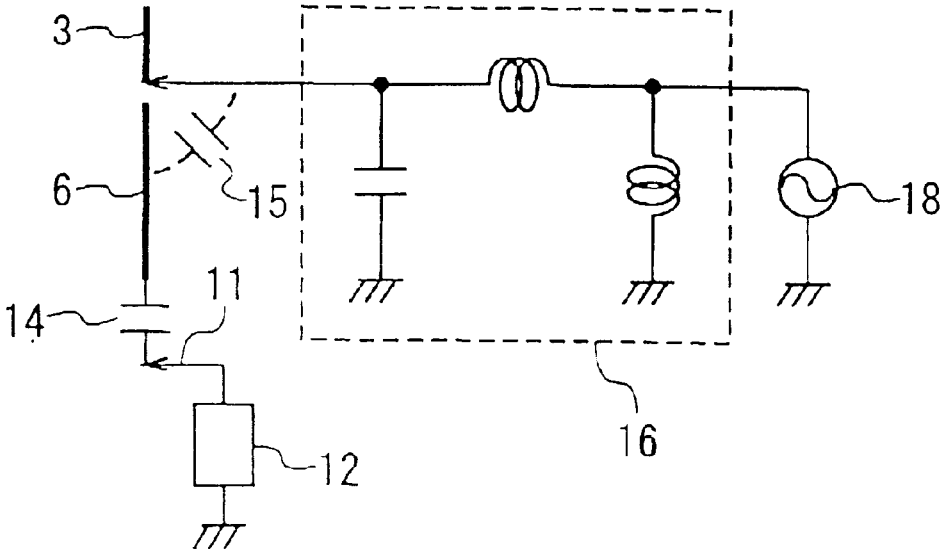
FIG. 11 is a circuit diagram showing the circuit configuration of the antenna according to the second embodiment of FIGS. 7A and 7B in the retracted state, where the rod-shaped element is connected to the radio circuit by way of the matching, circuit and the whip element is connected to the terminal matching circuit.

FIG. 11 shows the circuit configuration of the antenna 1A according to the second embodiment of FIGS. 7A and 7B in the retracted state. In this state, the bottom end of the rod-shaped element 3 is electrically connected to the radio circuit 18 by way of the same matching circuit 16. The bottom end of the element 3 is electrically connected to the top end of the whip element 6 by way of the adjusting capacitor 15. Furthermore, the bottom end of the whip element 6 is electrically connected to the conductive terminator 11, where the terminator 11 is electrically connected to the terminal matching circuit 12. The terminator 11 and the circuit 12 are provided in the casing 20.

If an adjusting inductance L needs to be added to the impedance of the antenna 1A, an inductor for generating the inductance L is realized with the terminal matching circuit 12. This is because the circuit 12 comprises at least one inductor and at least one capacitor. Specifically, since the circuit 12 is electrically connected to the element 6 by way of the terminator 11 and the stopper 9 and then, it is electrically connected to the linear element 3 by way of the adjusting capacitor 15. Therefore, the adjusting inductance L is added in parallel to the impedance of the antenna 1A. As a result, when the antenna 1A is in the retracted state, the input impedance value of the antenna 1A is adjusted by addition of the adjusting inductance L to the impedance of the element 3.

Since the value of the inductance L is simply adjusted by changing the characteristic of the terminal matching circuit 12, it can be adjusted easily.

A concrete example is as follows:

The casing 20 is of a rectangular parallelepiped with a size of 170 mm×50 mm×5 mm, the whip element 6 has a length of 46 mm ($\approx\lambda/4$), the rod-shaped element 3 has a length of 15 mm ($\approx\lambda/12$), the capacitance between the support 8 and the element 6 (i.e., the adjusting capacitor 14) is approximately 1 pF at 1460 MHz, and the overall inductance of the retracted part of the antenna 1A (which includes the adjusting inductance L) is approximately 11 nH at 1460 MHz.

Figure 12:
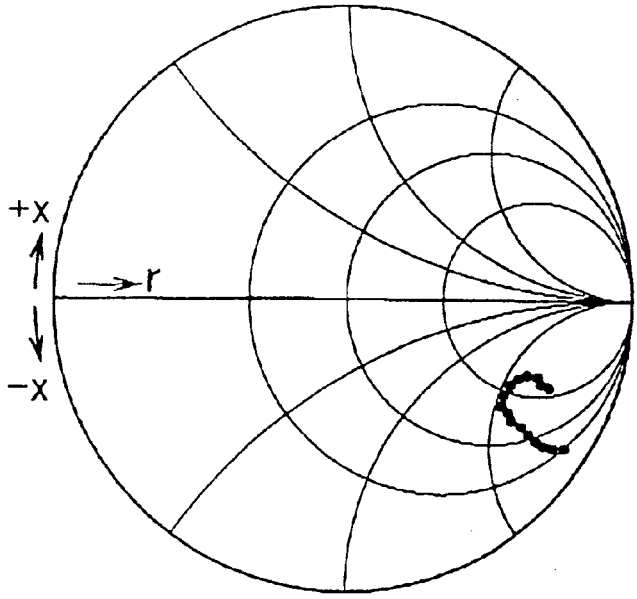
FIG. 12 is a Smith chart showing the adjusted input impedance of the antenna according to the second embodiment of FIGS. 7A and 7B in the extended state, where the whip element is active.
Figure 13:
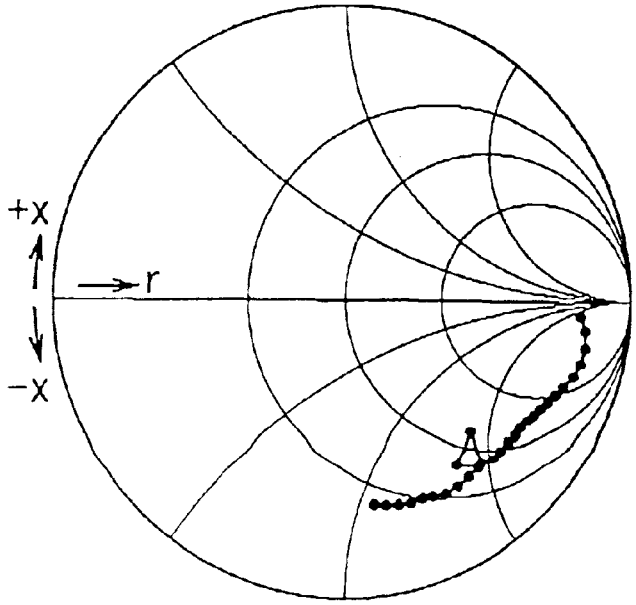
FIG. 13 is a Smith chart showing the adjusted input impedance of the antenna according to the second embodiment of FIGS. 7A and 7B in the retracted state, where the rod-shaped element is active.

FIG. 12 is a Smith chart showing the input impedance of the antenna 1A according to the second embodiment of FIGS. 7A and 7B in the extended state, in which the adjusting capacitance C of the capacitor 14 is added. FIG. 13 is a Smith chart showing the input impedance of the antenna 1A according to the second embodiment in the retracted state, in which the adjusting inductance L by the terminal matching circuit 12 is added. As see from FIGS. 12 and 13, the input impedance values of the antenna 1A are made closer.

As explained above, with the antenna 1A according to the second embodiment of FIGS. 7A and 7B, the adjusting capacitor 14 with the capacitance C is added to the antenna 1A (i.e., the whip element 6) in the extended state, where the input impedance of the antenna 1A contains a relatively larger resistance component. Also, the adjusting inductor with the inductance L is added to the antenna 1A (i.e., the linear element 3) in the retracted state, where the input impedance of the antenna 1A contains a relatively larger capacitance component. Accordingly, the input impedance values of the antenna 1A can be made closer or approximately the same in both the extended and retracted states. This means that the impedance matching characteristic of the antenna 1A is improved.

Figure 14A:
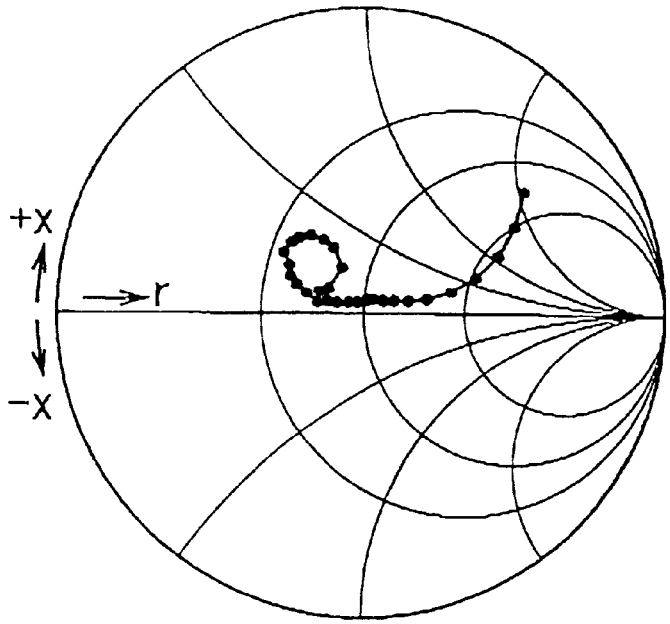
FIG. 14A is a Smith chart showing the input impedance of the antenna according to the second embodiment of FIGS. 7A and 7B in the extended state, where the impedance matching has been conducted.
Figure 14B:
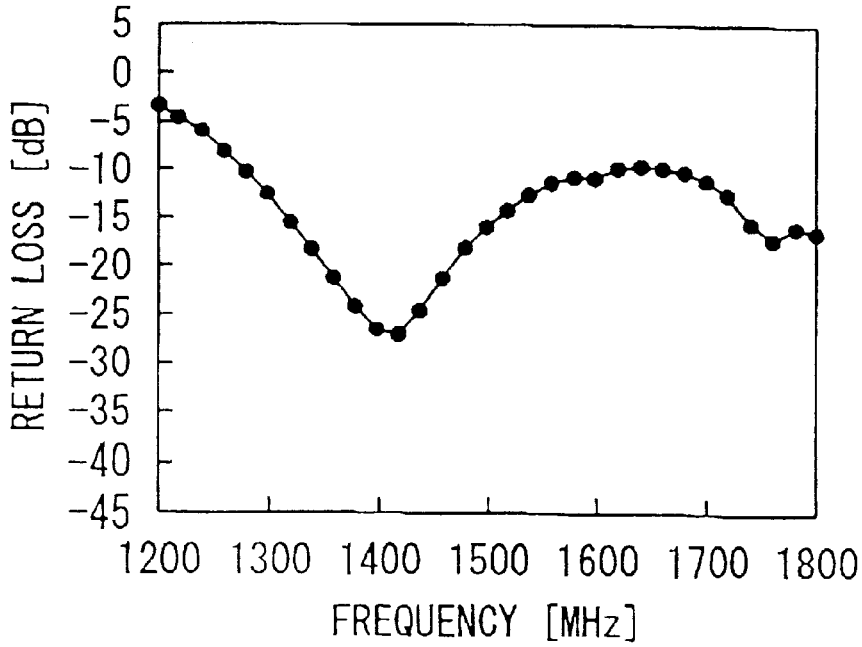
FIG. 14B is a graph showing the frequency characteristic of the return loss of the antenna according to the second embodiment of FIGS. 7A and 7B in the extended state, where the impedance matching has been conducted.
Figure 15A:
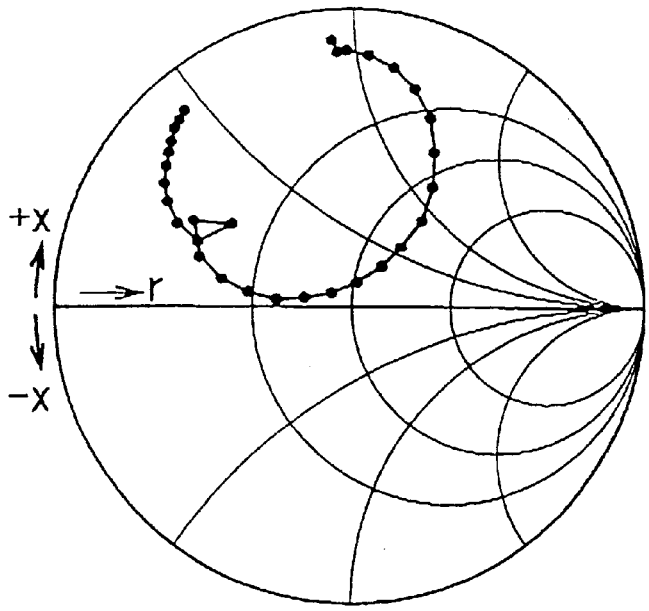
FIG. 15A is a Smith chart showing the input impedance of the antenna according to the second embodiment of FIGS. 7A and 7B in the retracted state, where the impedance matching has been conducted.
Figure 15B:
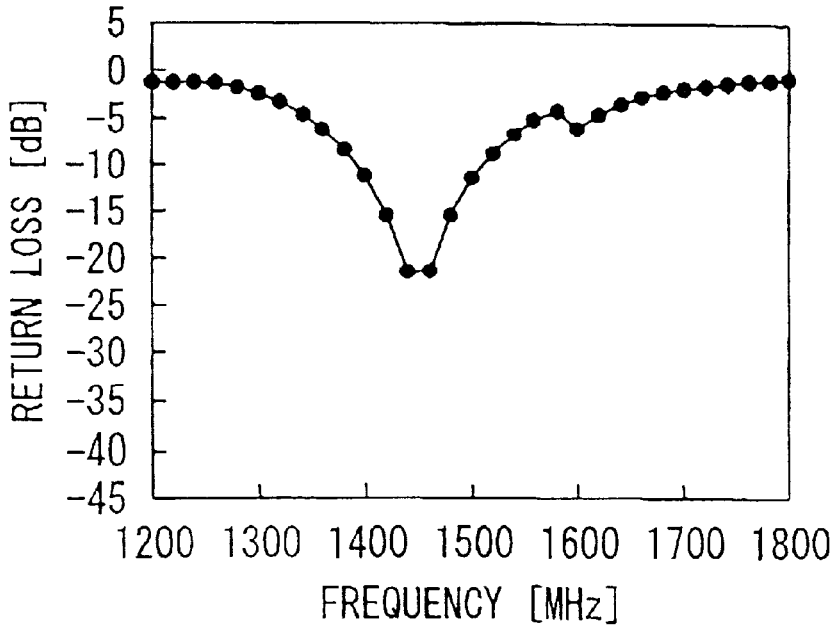
FIG. 15B is a graph showing the frequency characteristic of the return loss of the antenna according to the second embodiment of FIGS. 7A and 7B in the retracted state, where the impedance matching has been conducted.

FIG. 14A is a Smith chart showing the overall input impedance of the antenna 1A according to the second embodiment and FIG. 14B is a graph showing the frequency characteristic of the return loss of the same antenna 1A in the extended state. FIG. 15A is a Smith chart showing the overall input impedance of the same antenna 1A and FIG. 15B is a graph showing the frequency characteristic of the return loss of the same antenna 1A in the retracted state. The impedance matching has been conducted in these figures.

As seen from FIGS. 14A and 15A, the input impedance values of the antenna 1A in the extended and retracted states are made closer, which may be said that the input impedance is approximately matched. Also, as seen from FIGS. 14B and 15B, the return loss characteristics in the extended and retracted states are improved.

Due to the above-described reason, with the antenna 1A according to the second embodiment, the bandwidth at the operating frequency of 1.5 GHz is expanded even when the whip antenna 6 is retracted into the casing 20 (i.e., in the retracted state). Moreover, the input impedance values of the antenna 1A in the extended and retracted states can be approximately equalized in spite of the whip element 6 and the linear element 3 with different impedance values being used.

THIRD EMBODIMENT

Figure 16A:
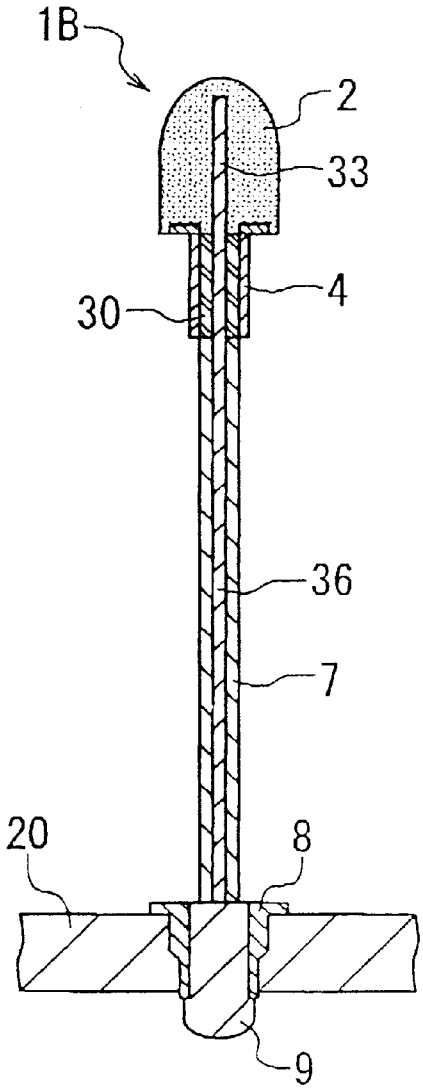
FIG. 16A is a schematic cross-sectional view of an antenna for portable radio device according to a third embodiment of the invention in the extended state.
Figure 16B:
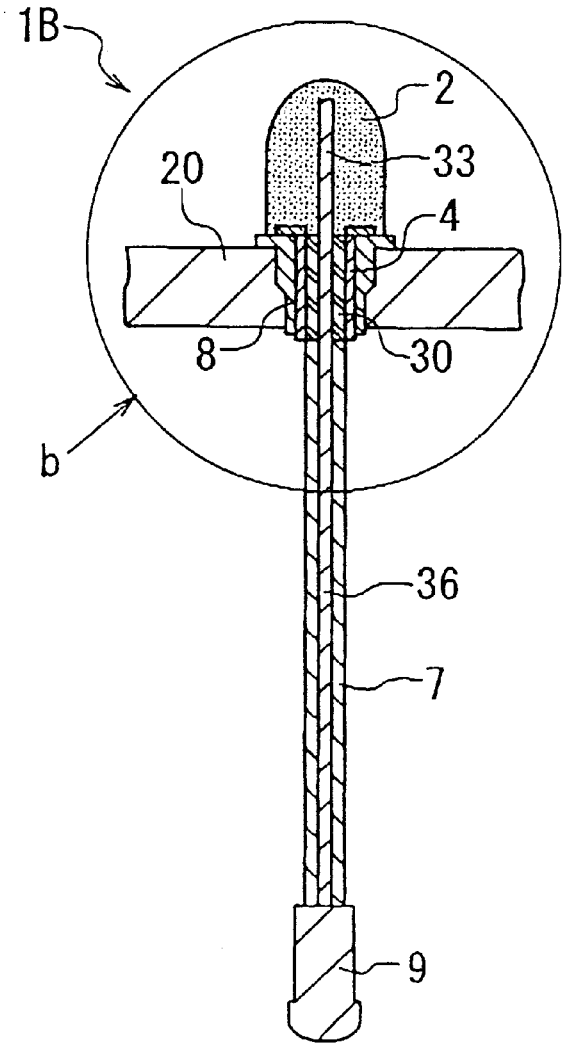
FIG. 16B is a schematic cross-sectional view of the antenna of FIG. 16A in the retracted state.
Figure 17:
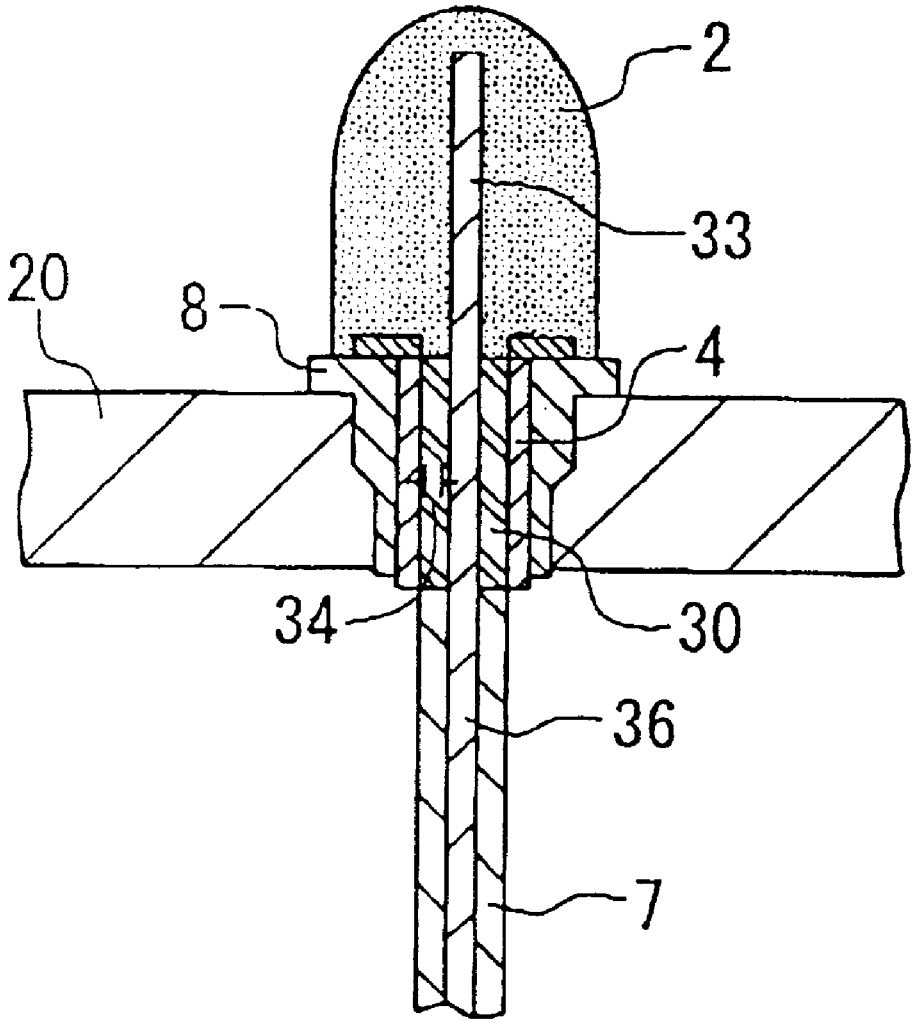
FIG. 17 is an enlarged, partial, schematic cross-sectional view of the area indicated by b in FIG. 16A.

FIGS. 16A and 16B, and 17 show an antenna 1B for portable radio device according to a third embodiment, which has the same configuration as that of the antenna 1 of the first embodiment of FIGS. 3A and 3B except that a linear element 33 is integrated with a whip element 36, that a dielectric 30 is formed between the top end part of the element 36 and the conductive feeder 4, and that the dielectric separator 5 is canceled. Therefore, the explanation about the same configuration is omitted here by attaching the same reference symbols as those used in the first embodiment to the same elements or parts in FIGS. 16A, 16B, and 17 for the sake of simplification.

With the antenna 13 of the third embodiment, the linear or element 33 is integrated with the whip element 36 and thus, these elements 33 and 36 are electrically connected to each other. (It maybe said that the element 33 also is a whip element.) Therefore, when the antenna 1B is in the extended state, as shown in FIG. 16A, both the elements 33 and 36 are activated and perform their operations. On the other hand, when the antenna 1B is in the retracted state, as shown in FIG. 16B, only the linear element 33 performs its operation, because substantially no electric power is fed to the element 36.

Accordingly, like the antenna 1 according to the first embodiment of FIGS. 3A and 3B, the bandwidth at the operating frequency of 1.5 GHz is expanded by suitably setting the length of the casing 20 when the whip element 36 is retracted into the casing 20 (in the retracted state of the antenna 1B). Concretely, the bandwidth in the retracted state can be expanded to twice as wide as that of the prior-art antenna 101 including the helical element 117 or greater.

Moreover, the whip element 36 is electrically insulated from the feeder 4 by the dielectric 30. When the antenna 1B is in the retracted state, the conductive feeder 4 is contacted with the conductive support 8 and electrically connected thereto, as shown in FIG. 17. In this state, the feeder 4, the element 36, and the intervening dielectric 10 constitute an adjusting capacitor 34. Therefore, electric power is supplied from the radio circuit 18 to the element 33 by way of the capacitor 34. This means that the capacitance C of the capacitor 34 is added to the input impedance of the antenna 1B.

The capacitance C of the capacitor 34 is adjusted by changing the value of at least one of the dielectric constant of the dielectric 30, the distance or interval between the whip element 36 and the opposing feeder 4, and the length of the feeder 4. Therefore, the value of the capacitance C can be adjusted or optimized easily.

Figure 18:
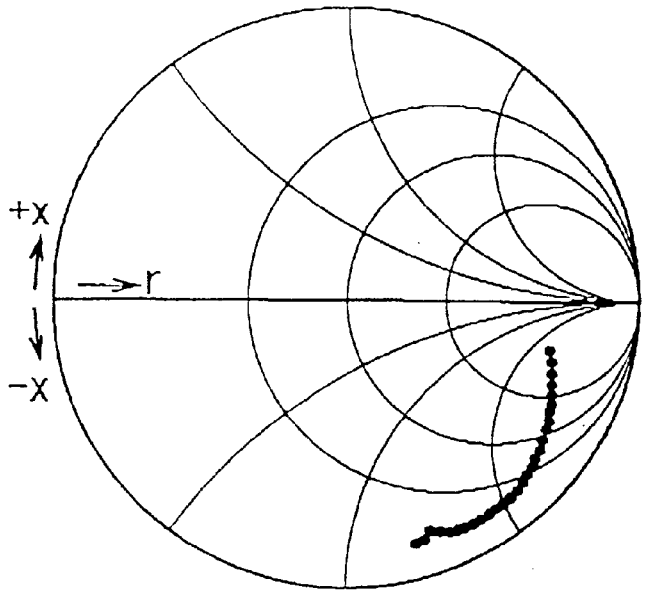
FIG. 18 is a Smith chart showing the input impedance of the antenna according to the third embodiment of FIGS. 16A and 16B in the extended state.
Figure 19:
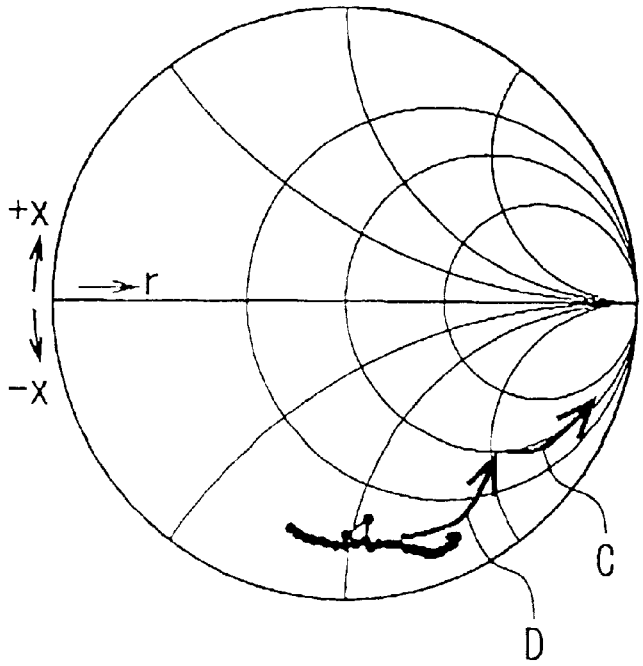
FIG. 19 is a Smith chart showing the input impedance of the antenna according to the third embodiment of FIGS. 16A and 16B in the retracted state.

FIG. 18 is a Smith chart showing the input impedance of the antenna 1B (i.e., the whip elements 36 and 33) according to the third embodiment in the extended state. In FIG. 18, the calculated values in the vicinity of 1.5 GHz are plotted. FIG. 19 is a Smith chart showing the input impedance of the same antenna 1B (i.e., the whip element 33) in the retracted state. In FIGS. 18 and 19, the calculated values in the vicinity of 1.5 GHz are plotted.

As seen from FIGS. 18 and 19, the input impedance of the antenna 1B is located near the OPEN of the chart while it is located near the periphery thereof.

Comparing the dots in FIGS. 18 and 19 with each other, it is seen that the input impedance of the antenna 1B of the third embodiment in the extended state includes a lower resistance component and a lower capacitance component than those of the antenna 1B in the retracted state. This is unlike the above-explained antenna 1 of the first embodiment, where the input impedance of the antenna 1 in the extended state includes a lower resistance component and a higher capacitance component than those so the antenna 1 in the retracted state. Thus, the input impedance values of the antenna 1B in the retracted and extended states do not approximated or made closer with each other. As a result, desired impedance matching is unable to be realized using the same matching circuit.

However, if a proper impedance element or elements is/are added to the antenna 1B (i.e., the element 33) to shift the group of the dots along the arrows C and D in FIG. 19, the impedance values of the antenna 12 in the retracted and extended states can be made closer, resulting in desired impedance matching.

Specifically, in the retracted state where the whip element 36 is located inside the casing 20, if an adjusting capacitor with a specific capacitance C is added to the linear element 33 in series, the overall input impedance value of the antenna 1A is shifted along the arrow C in FIG. 19. Also, if an adjusting inductor with a specific inductance L is added to the element 33 in parallel, the overall input impedance value of the antenna 13 is shifted along the arrow D in FIG. 19. Thus, by adjusting or optimizing the values of the capacitance C and the inductance L thus added, desired impedance matching can be realized.

Next, a method of adjusting the input impedance value of the antenna 1B according to the third embodiment is explained below.

Figure 20:
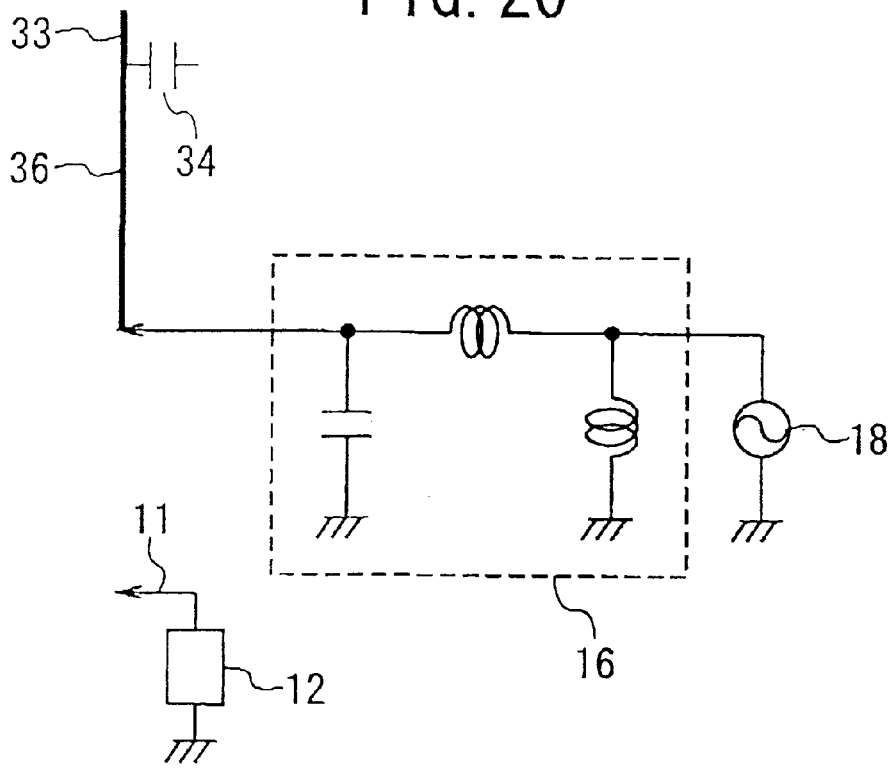
FIG. 20 is a circuit diagram showing the circuit configuration of the antenna according to the third embodiment of FIGS. 16A and 16B in the extended state, where the whip and rod-shaped elements are connected to the radio circuit by way of the matching circuit.

In the extended state of the antenna 1B, as shown in FIG. 20, both the elements 36 and 33 are electrically connected to the conductive stopper 9 and then, they are electrically connected to the radio circuit 18 by way of the matching circuit 16. The capacitor 34 is not connected to the elements 33 and 36.

Figure 21:
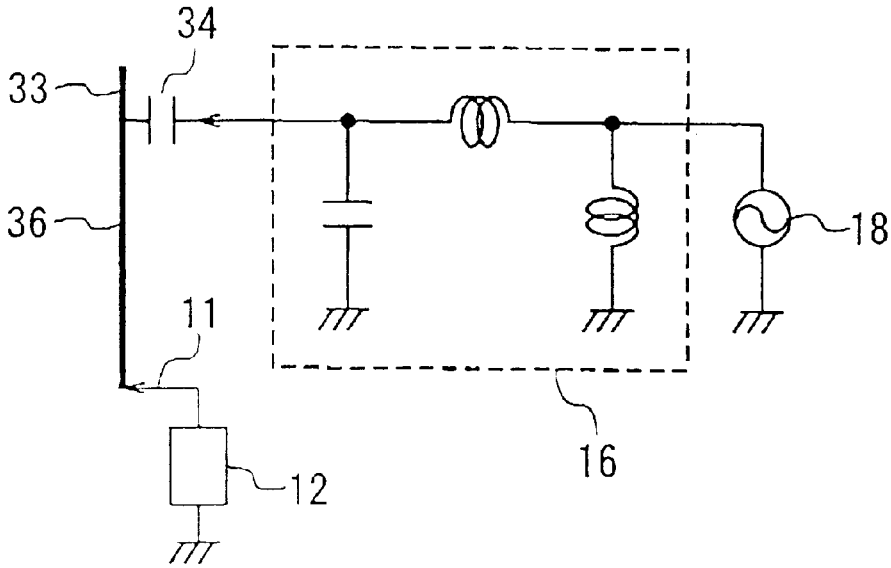
FIG. 21 is a circuit diagram showing the circuit configuration of the antenna according to the third embodiment of FIGS. 16A and 16B in the retracted state, where the whip and rod-shaped elements are connected to the radio circuit by way of the matching circuit and the terminal matching circuit in parallel.

In the retracted state of the antenna 1B, as shown in FIG. 21, only the element 33 is electrically connected to the radio circuit 18 by way of the capacitor 34 and the matching circuit 16. At the same time as this, the bottom end of the element 36 is electrically connected to the terminal matching circuits 12 by way of the conductive terminator 11.

To add an adjusting inductance L to the impedance of the antenna 1B, an adjusting inductor (not shown) for generating the adjusting inductance L is formed by the terminal matching circuit 12 comprising at least one inductor and at least one capacitor. The adjusting inductor thus formed in the circuit 12 is electrically connected to the elements 36 and 33 by way of the terminator 11 and the stopper 9. In other words, the adjusting inductance L is added in parallel to the impedance of the antenna 1B. As a result, the input impedance value of the antenna 1B in the retracted state is adjusted or optimized by addition of the inductance L to the impedance of the elements 36 and 33.

Since the value of the inductance L is adjusted by changing the characteristic of the terminal matching circuit 12, it can be adjusted easily.

A concrete example is as follows:

The casing 20 is of a rectangular parallelepiped with a size of 170 mm×50 mm×5 mm, the whip element 36 has a length of 76 mm, the linear element 33 has a length of 15 mm ($\approx\lambda/12$), the capacitance between the feeder 4 and the elements 36 and 33 (i.e., the adjusting capacitance C) is approximately 3.2 pF at 1460 MHz, and the overall inductance of the retracted part of the antenna 1B (i.e., the adjusting inductance L) is approximately 17.5 nH at 1460 MHz. In the extended state, the overall length of the whip element 36 and the linear element 33 are active and therefore, the sum length of the elements 36 and 33 is meaningful. Thus, the overall length in this state is 91 mm (=76 mm+15 mm), which is approximately equal to ($\lambda/2$).

Figure 22:
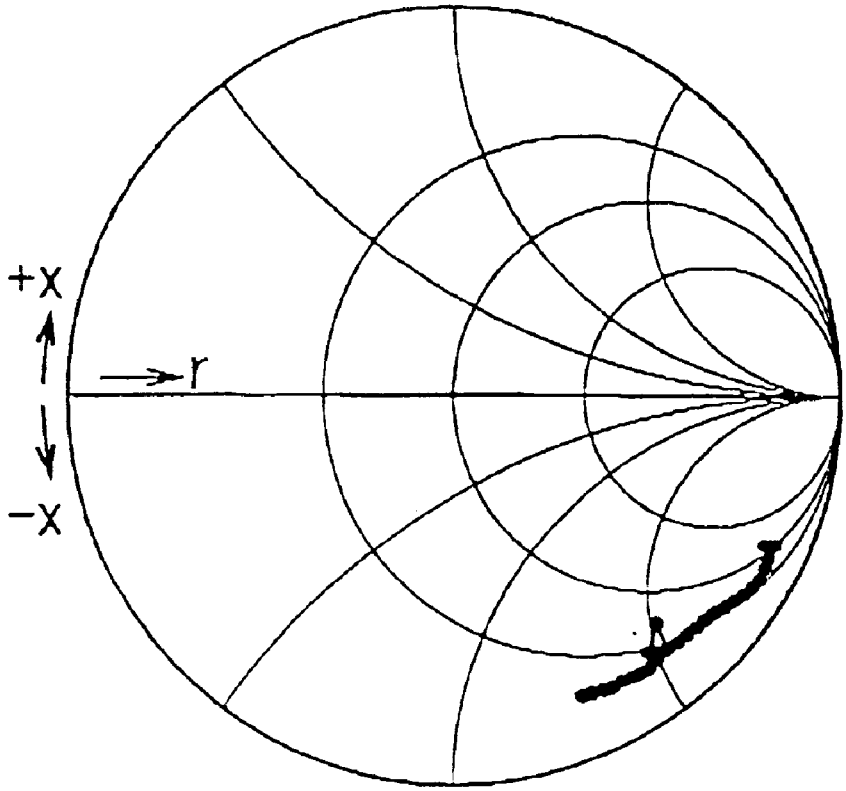
FIG. 22 is a Smith chart showing the adjusted input impedance of the antenna according to the third embodiment of FIGS. 16A and 16B in the retracted state, where the whip and rod-shaped elements are active.

FIG. 22 is a Smith chart showing the input impedance of the antenna 1B according to the third embodiment in the retracted state, in which the adjusting capacitance C of the capacitor 34 and the adjusting inductance L by the terminal matching circuit 12 are added. Comparing FIG. 22 with FIG. 18, it is seen that the input impedance values of the antenna 1B in the extended and retracted states are well approximated.

As explained above, with the antenna 1B according to the third embodiment of FIGS. 16A and 16B, the capacitor 34 with the capacitance C is added to the antenna 1B in the extended state and the inductor with the inductance L is added thereto in the retracted state. Accordingly, the input impedance values of the antenna 1B can be made approximately the same in both the extended and retracted states. This means that the antenna 1B has a good impedance matching characteristic as desired.

Figure 23A:
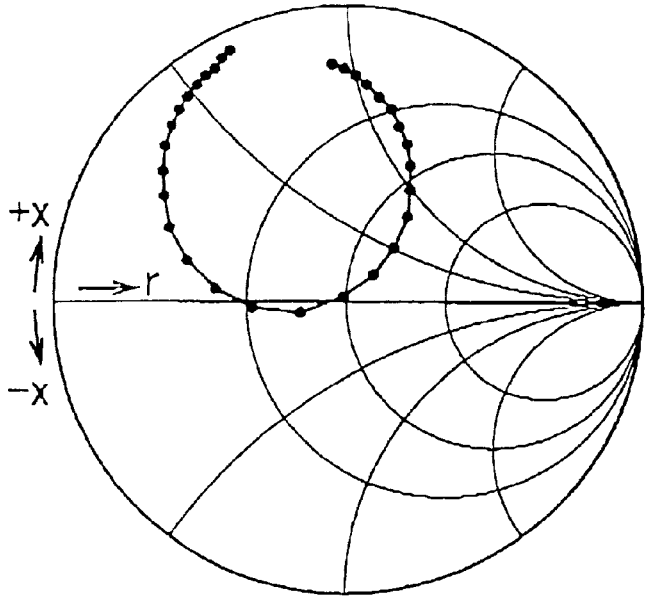
FIG. 23A is a Smith chart showing the input impedance of the antenna according to the third embodiment of FIGS. 16A and 16B in the extended state, where the impedance matching has been conducted.
Figure 23B:
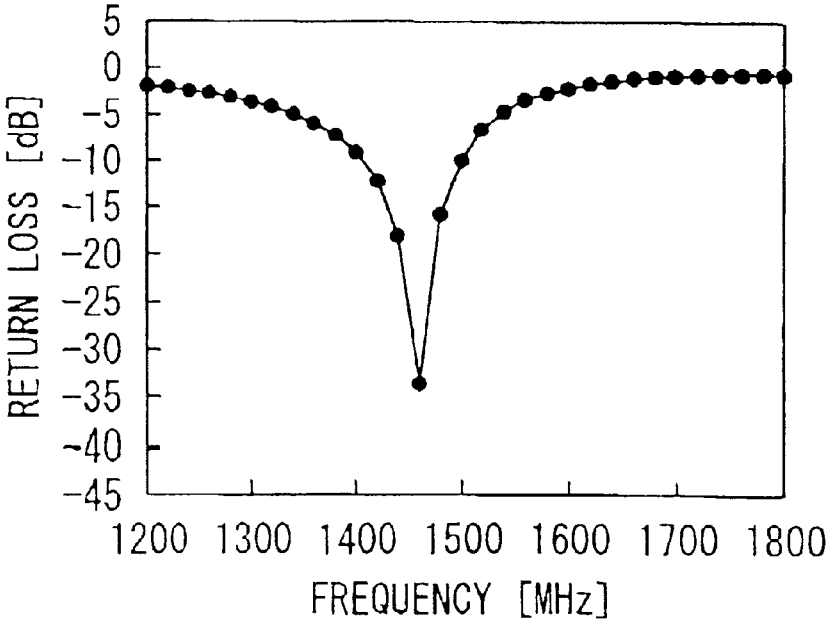
FIG. 23B is a graph showing the frequency characteristic of the return loss of the antenna according to the third embodiment of FIGS. 16A and 16B in the extended state, where the impedance matching has been conducted.
Figure 24A:
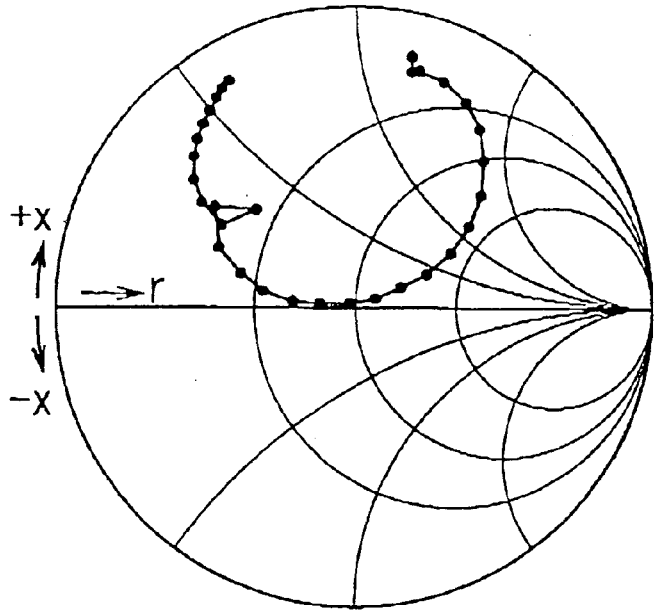
FIG. 24A is a Smith chart showing the input impedance of the antenna according to the third embodiment of FIGS. 16A and 16B in the retracted state, where the impedance matching has been conducted.
Figure 24B:
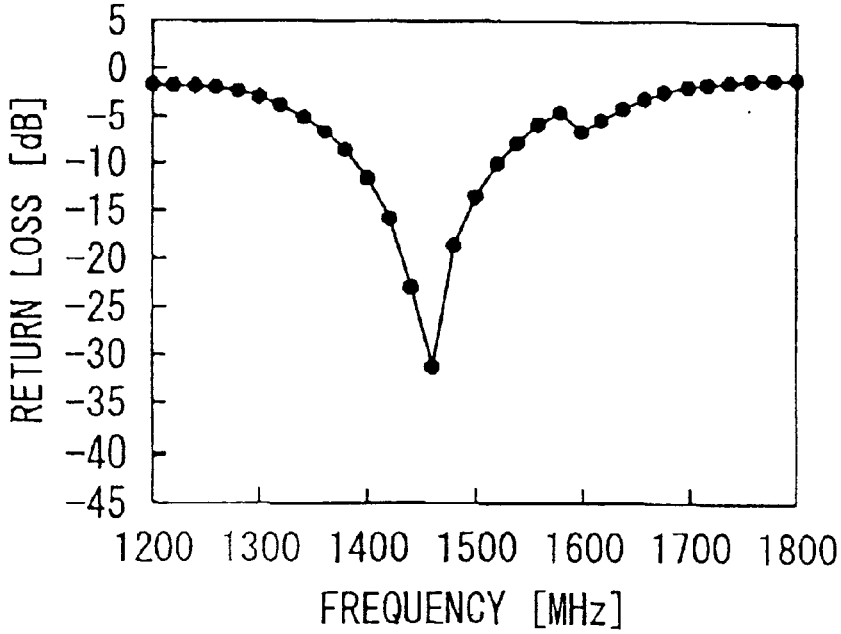
FIG. 24B is a graph showing the frequency characteristic of the return loss of the antenna according to the third embodiment of FIGS. 16A and 16B in the retracted state, where the impedance matching has been conducted.

FIGS. 23A and 23B are a Smith chart showing the input impedance of the antenna 1B of the third embodiment and a graph showing the frequency characteristic of the return loss thereof in the extended state. FIGS. 24A and 24B are a Smith chart showing the input impedance of the antenna 1B and a graph showing the frequency characteristic of the return loss thereof in the retracted state.

As seen from FIGS. 23A and 24A, the input impedance values of the antenna 1B in the extended and retracted states are approximately the same. Also, as seen from FIGS. 23B and 24B, the return loss characteristics of the antenna 1B in the extended and retracted states are improved.

Due to the above-described reason, with the antenna 1B according to the third embodiment, the bandwidth at the operating frequency of 1.5 GHz can be expanded even in the retracted state. Moreover, the input impedance values of the antenna 1B in the extended and retracted states can be approximately equalized. This is the same as the antenna 1A of the second embodiment.

FOURTH EMBODIMENT

Figure 25A:
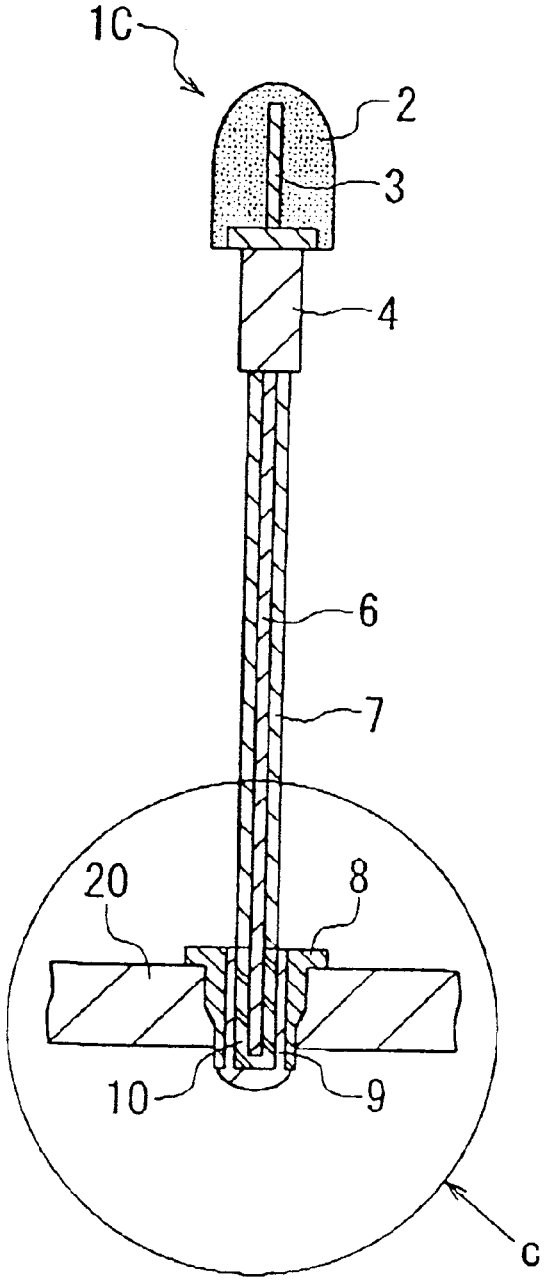
FIG. 25A is a schematic cross-sectional view of an antenna for portable radio device according to a fourth embodiment of the invention in the extended state.
Figure 25B:
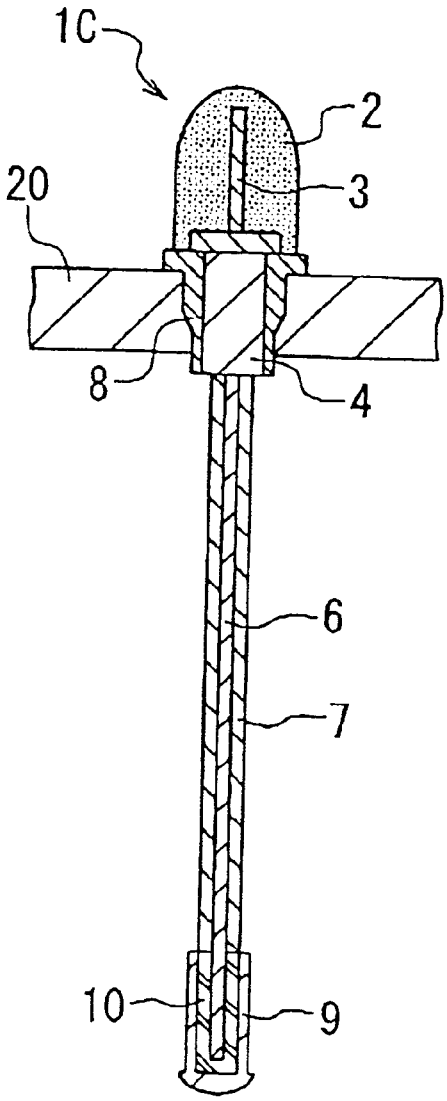
FIG. 25B is a schematic cross-sectional view of the antenna of FIG. 25A in the retracted state.
Figure 26:
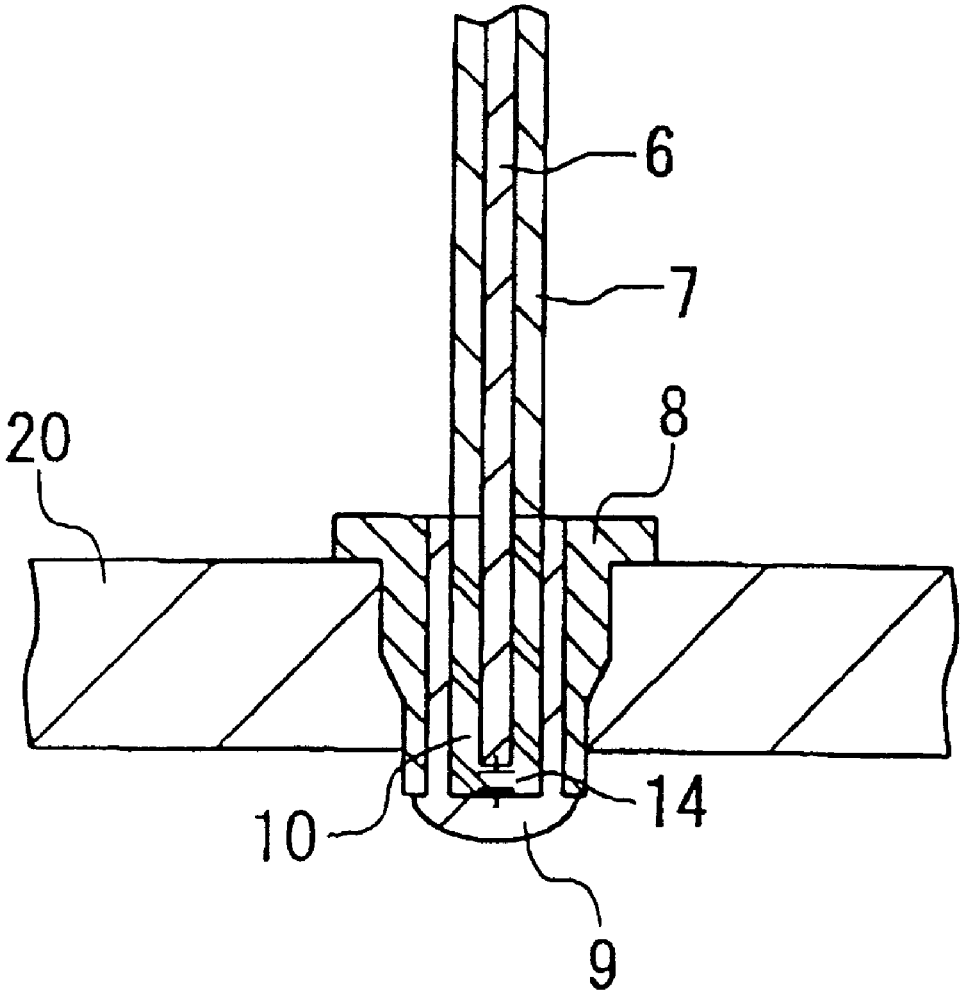
FIG. 26 is an enlarged, partial, schematic cross-sectional view of the area indicated by c in FIG. 25A.

FIGS. 25A and 25B, and 26 show an antenna 1C for portable radio device according to a fourth embodiment, which has the same configuration as that of the antenna 1A of the second embodiment of FIGS. 7A and 7B except that the dielectric separator 5 is canceled and that the linear element 3 is electrically connected to the whip element 6 by way of the conductive feeder 4. Therefore, the explanation about the same configuration is omitted here by attaching the same reference symbols as those used in the second embodiment to the same elements or parts in FIGS. 25A and 25B, and 26 for the sake of simplification.

With the antenna 1C of the fourth embodiment, the linear or rod-shaped element 3 is electrically connected to the whip element 6 and thus, both the elements 3 and 6 perform their operations in the extended state, as shown in FIG. 25A. On the other hand, in the retracted state, as shown in FIG. 25B, only the linear element 3 performs its operation.

Accordingly, like the antenna 1B according to the third embodiment, the bandwidth at the operating frequency can be expanded by suitably setting the length of the casing 20 in the retracted state. Concretely, the bandwidth in the retracted state can be expanded to twice as wide as that of the prior-art antenna 101 including the helical element 117 or more.

Also, as shown in FIG. 26, like the antenna 1A of the second embodiment, of FIGS. 7A and 7B, the conductive stopper 9, the conductive element 6, and the intervening dielectric 10 constitute the adjusting capacitor 14.

Figure 27:
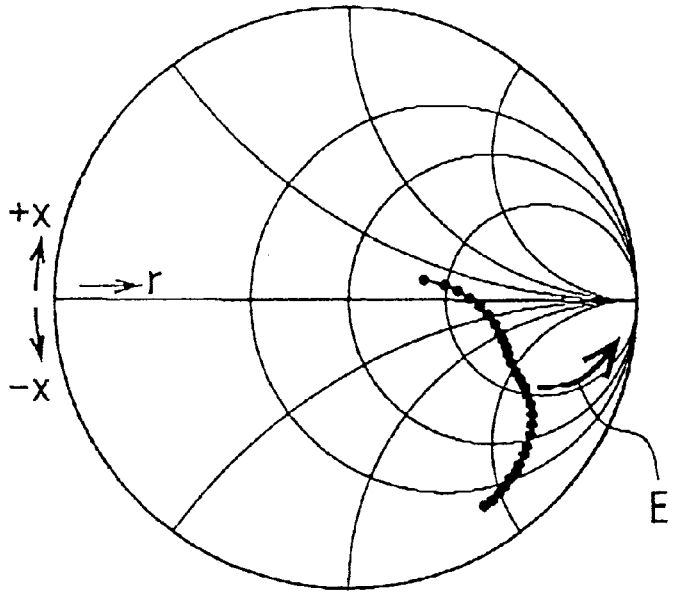
FIG. 27 is a Smith chart showing the input impedance of the antenna according to the fourth embodiment of FIGS. 25A and 25B in the extended state.
Figure 28:
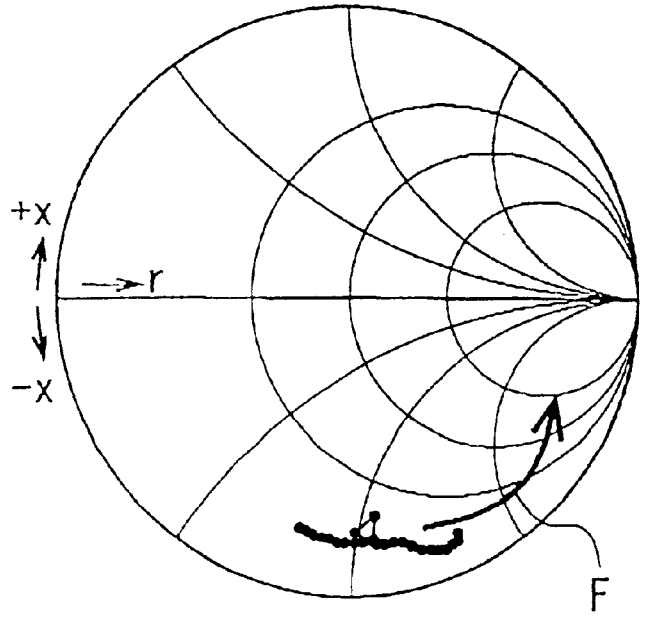
FIG. 28 is a Smith chart showing the input impedance of the antenna according to the fourth embodiment of FIGS. 7A and 7B in the retracted state.

As seen from FIG. 27 showing the input impedance of the antenna 1C of the fourth embodiment in the extended state, the input impedance values of the antenna 1C are located near the OPEN of the Smith chart In the retracted state, as seen from FIG. 28 showing the input impedance of the same antenna 1C in the retracted state, the input impedance values of the antenna 1C are located near the periphery of the Smith chart.

Comparing the dots in FIGS. 27 and 28 with each other, it is seen that the input impedance of the antenna 1C of the fourth embodiment in the extended state includes a lower resistance component than that of the antenna 1C in the retracted state. This means that the input impedance values of the antenna 1D in the retracted and extended states do not accord with each other. As a result, desired impedance matching is unable to be realized using the same matching circuit.

To shift the groups of the dots along the arrows E and F in FIGS. 27 and 28, respectively, proper adjusting impedance elements are added to the antenna 1C in the retracted and extended states. In this case, desired impedance matching can be realized.

Specifically, in the extended state, an adjusting capacitor with the capacitance C is added in series to the elements 6 and 3, shifting the overall input impedance value or the antenna 1C along the arrow E in FIG. 27. In the retracted state, an adjusting inductor with the inductance L is added in parallel to the antenna 1C, shifting the overall input impedance value of the antenna 1C along the arrow F in FIG. 28. By adjusting or optimizing the values of the capacitance C and the inductance L thus added, desired impedance matching can be realized.

Next, a method of adjusting the input impedance value of the antenna 1C of the fourth embodiment is explained below.

Figure 29:
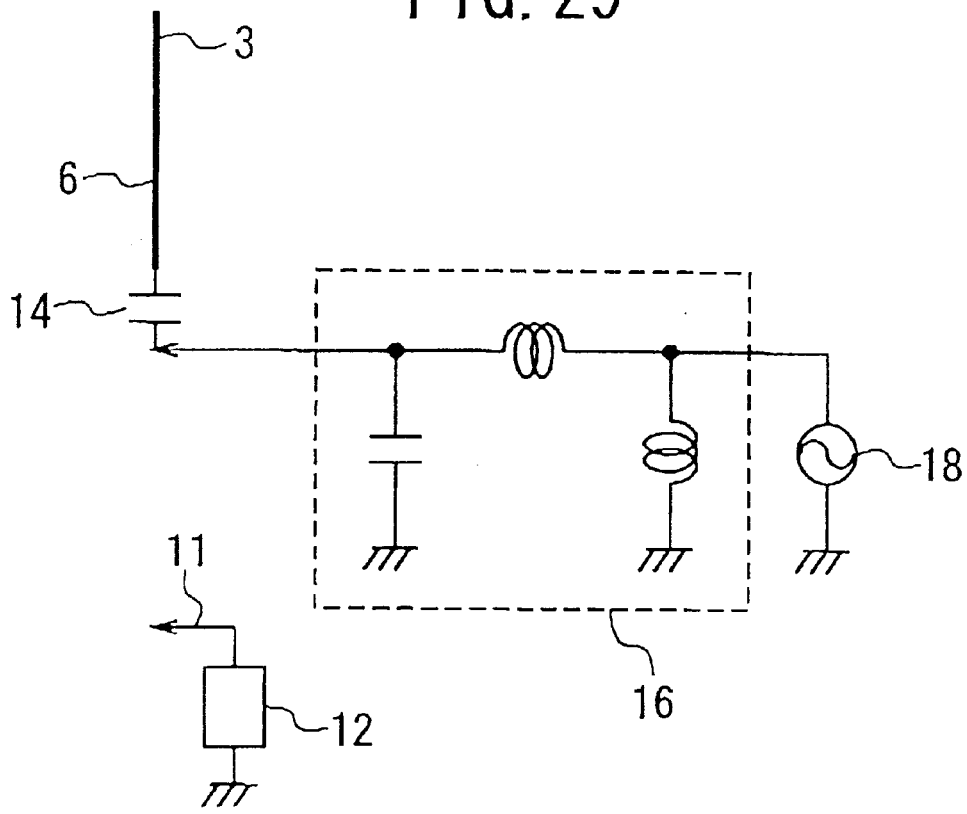
FIG. 29 is a circuit diagram showing the circuit configuration of the antenna according to the fourth embodiment of FIGS. 25A and 25B in the extended state, where the whip and rod-shaped elements are connected to the radio circuit by way of the matching circuit.

In the extended state, as shown in FIG. 29, the bottom end of the whip element 6 is electrically connected to the radio circuit 18 by way of the adjusting capacitor 14 and the matching circuit 16. Thus, the capacitance C of the capacitor 14 is added to the total impedance of the antenna elements 3 and 6. As a result, the input impedance value of the antenna 1C is adjusted by addition of the capacitance C.

Figure 30:
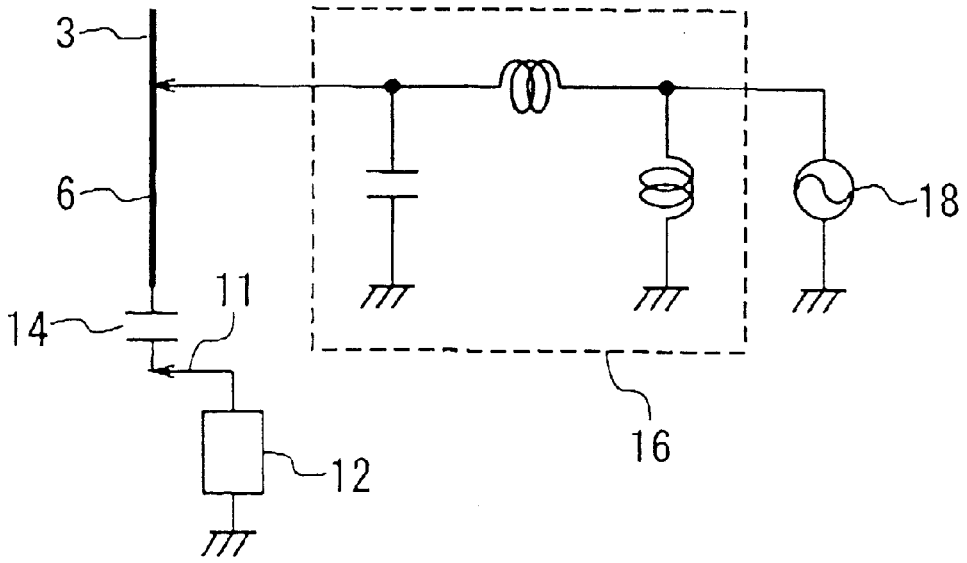
FIG. 30 is a circuit diagram showing the circuit configuration of the antenna according to the fourth embodiment of FIGS. 25A and 25B in the retracted state, where the whip and rod-shaped elements are connected to the radio circuit by way of the matching circuit and the terminal matching circuit in parallel.

In the retracted state, as shown in FIG. 30, the bottom end of the linear element 3 is electrically connected to the radio circuit 18 by way of the matching circuit 16. At the same time as this, the bottom end of the whip element 6 is electrically connected to the terminal matching circuit 12 by way of the capacitor 14 and the conductive terminator 11. To add an adjusting inductance L to the impedance of the whip element 6, an inductor for generating the inductance L is realized with the circuit 12 comprising at least one inductor and at least one capacitor. As a result, the input impedance value of the antenna 1C is adjusted by addition of the inductance L.

A concrete example is as follows:

The casing 20 is of a rectangular parallelepiped with a size of 170 mm×50 mm×5 mm, the whip element 6 has a length of 61 mm, the linear element 3 has a length of 15 mm, the capacitance C between the stopper 9 and the element 6 (i.e., the adjusting capacitor 14) is approximately 2 pF at 1460 MHz, and the overall inductance of the retracted part of the antenna 1C (i.e., the adjusting inductor) is approximately 8.8 nH at 1460 MHz. In the extended state, the overall length of the whip element 6 and the linear element 3 are active and therefore, the sum length of the elements 6 and 3 is meaningful. Thus, the overall length in this state is 76 mm (=61 mm+15 mm), which is approximately equal to ($3\lambda/8$).

Figure 31:
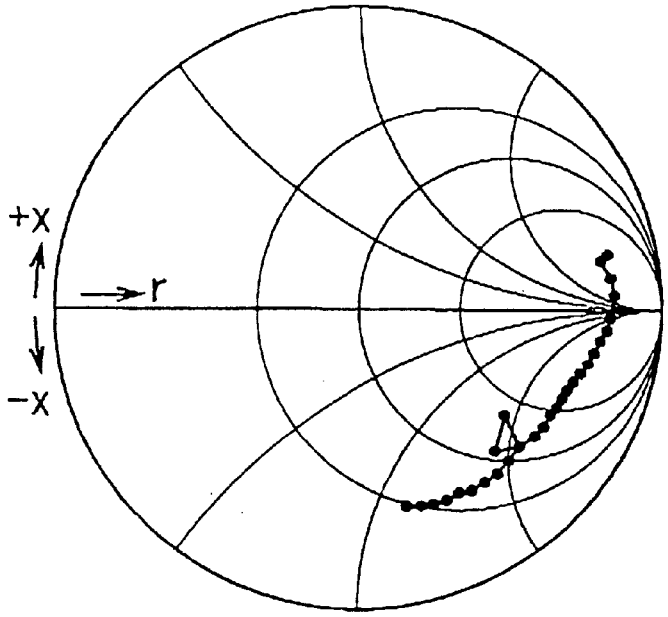
FIG. 31 is a Smith chart showing the adjusted input impedance of the antenna according to the fourth embodiment of FIGS. 25A and 25B in the extended state.
Figure 32:
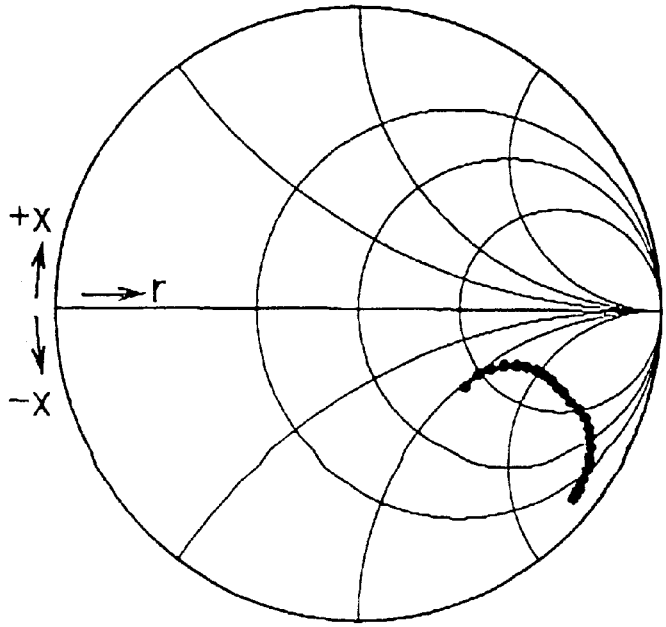
FIG. 32 is a Smith chart showing the adjusted input impedance of the antenna according to the fourth embodiment of FIGS. 25A and 25B in the retracted state.

As seen from FIGS. 31 and 32 showing the input impedance of the antenna 1C of the fourth embodiment in the extended and retracted states, respectively, the input impedance values of the antenna 1C in these two states are made closer than those shown in FIGS. 27 and 28. As a result, desired impedance matching is unable to be realized using the same matching circuit.

Figure 33A:
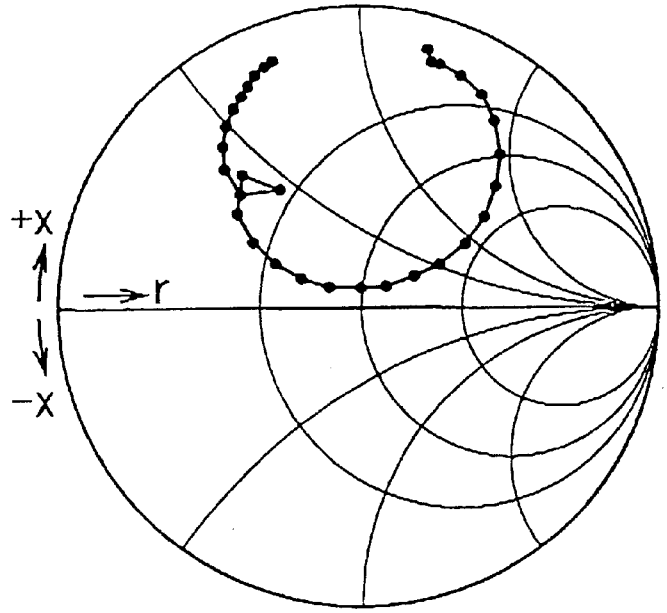
FIG. 33A is a Smith chart showing the input impedance of the antenna according to the fourth embodiment of FIGS. 25A and 25B in the extended state, where the impedance matching has been conducted.
Figure 33B:
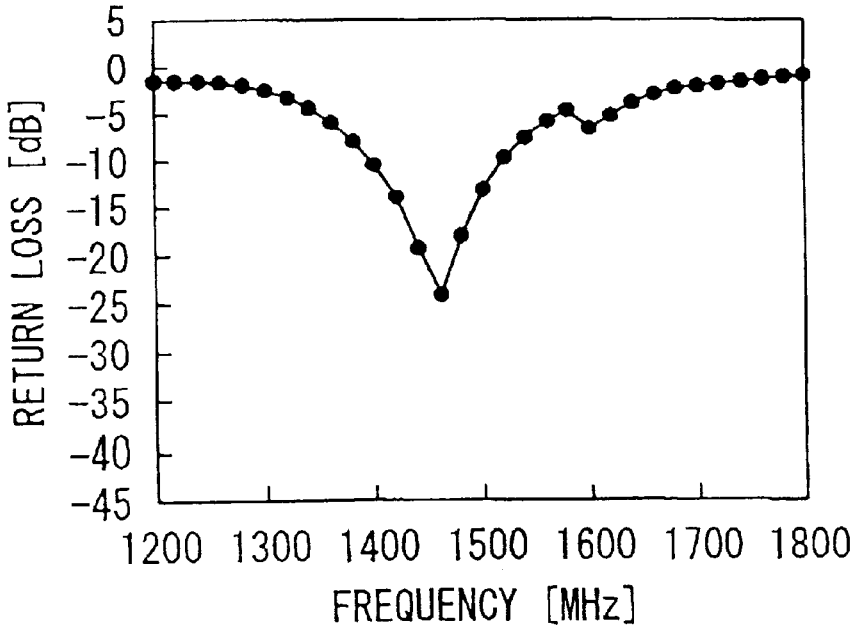
FIG. 33B is a graph showing the frequency characteristic of the return loss of the antenna according to the fourth embodiment of FIGS. 25A and 25B in the extended state, where the impedance matching has been conducted.
Figure 34A:
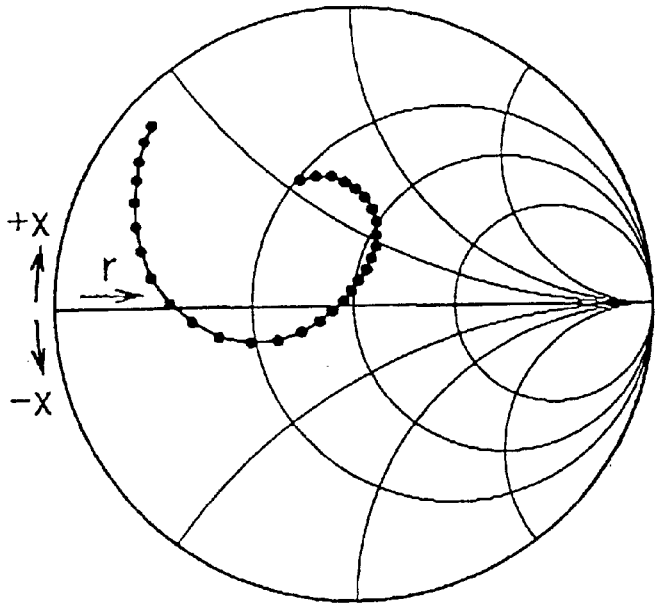
FIG. 34A is a Smith chart showing the input impedance of the whip element of the antenna according to the fourth embodiment of FIGS. 25A and 25B when the whip element is retracted into the casing, where the impedance matching has been conducted.
Figure 34B:
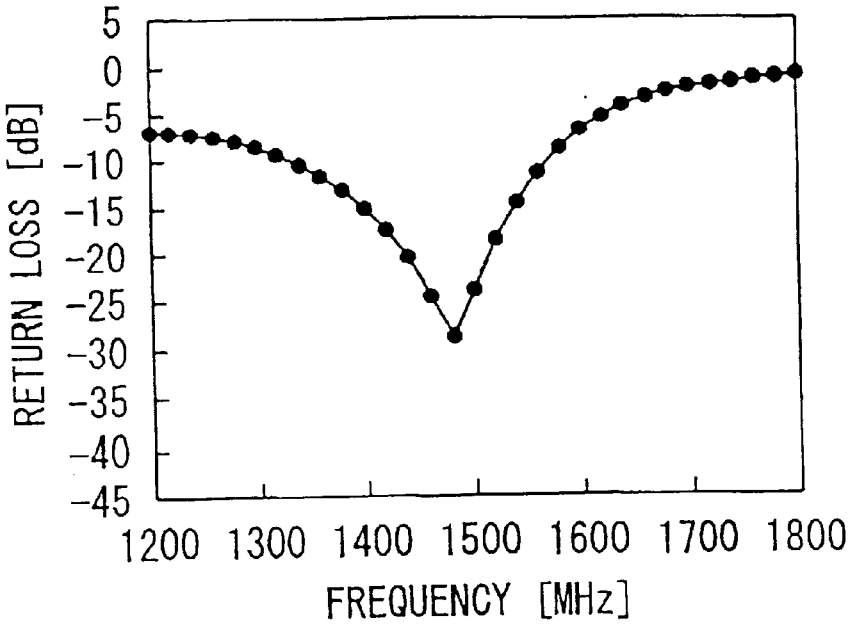
FIG. 34B is a graph showing the frequency characteristic of the return loss of the antenna according to the fourth embodiment of FIGS. 25A and 25B in the retracted state, where the impedance matching has been conducted.

As seen from FIGS. 33A and 34A, the input impedance values of the antenna 1C of the fourth embodiment in the extended and retracted states are approximately the same. Also, as seen from FIGS. 33B and 34B, the return loss characteristics of the same antenna 1C in the extended and retracted states are improved.

Due to the above-described reason, with the antenna 1C according to the fourth embodiment, the bandwidth at the operating frequency of 1.5 GHz is expanded even in the retracted state. Moreover, the input impedance values so the antenna 1C in the extended and retracted states can be approximately equalized. This is the same as the antenna 1A of the second embodiment.

VARIATIONS

It is needless to say that the invention is not limited to the above-described first to fourth embodiments.

For example, in the antennas 1A and 1C according to the second and fourth embodiments, to constitute the adjusting capacitor 14, the stopper 9 may be made of the same dielectric material as the dielectric 10 and at the same time, a proper metal piece may be added thereto. In this case, there is an additional advantage that the capacitance C of the capacitor 14 may be adjusted by changing at least one of the distance or interval of the metal piece and the whip element 6 and the length of the opposing part of the metal piece to the element 6. An example of this configuration is shown in FIG. 35.

Figure 35:
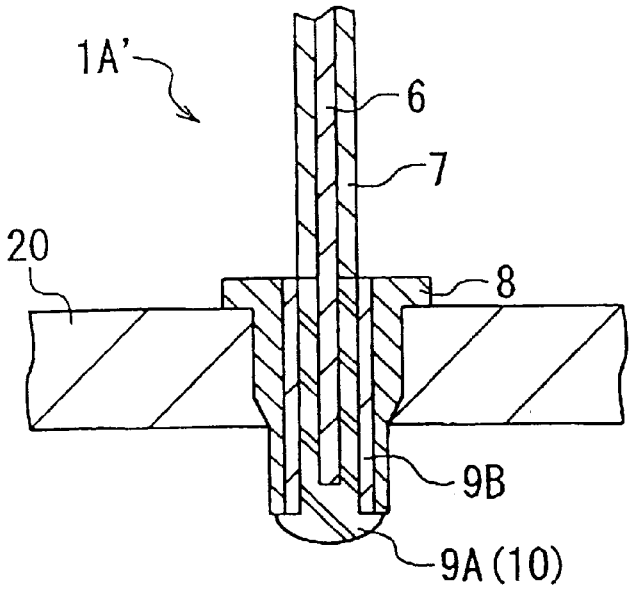
FIG. 35 is an enlarged, partial, schematic cross-sectional view of a variation of the antenna according to the second embodiment of FIGS. 7A and 7B, which is similar to FIG. 8.

In FIG. 35, the antenna 1A' comprises a dielectric stopper 9A, which is made of the same dielectric material as the dielectric 10 in the second embodiment. A metal piece 9B is attached to the surface of the stopper 9A.

Also, in the first embodiment, the whip element 6 and the linear element 3 are formed separately from each other with the dielectric separator 5. However, these two elements 6 and 3 may be formed as an integrated element similar to the antenna 1B of the third embodiment of FIGS. 16A and 16B. In this case, a part of the integrated element that is retracted into the casing 20 in the retracted state serves as the whip element 6 while another (or remaining) part of the integrated element that is not retracted into the casing even in the retracted state serves as the linear or rod-shaped element 3.

Furthermore, in the antenna 1B of the third embodiment of FIGS. 16A and 16B, the feeder 4 may be canceled and at the same time, a proper metal piece may be added to the surface of the dielectric 30, thereby constituting the adjusting capacitor 34. In this case, there is an additional advantage that the capacitance C of the capacitor 34 may be adjusted by changing at least one of the distance or interval of the metal piece and the whip element 6 and the length of the opposing part of the metal piece to the element 6. An example of this configuration is shown in FIG. 36.

Figure 36:
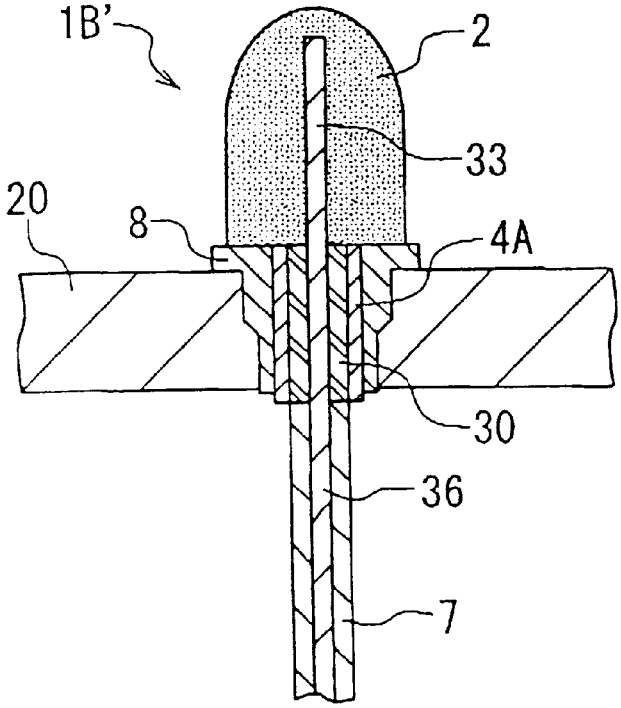
FIG. 36 is an enlarged, partial, schematic cross-sectional view of a variation of the antenna according to the third embodiment of FIGS. 16A and 16B, which is similar to FIG. 17.

In FIG. 36, the antenna 1B' comprises the dielectric 30 and a metal piece 4A attached to the surface of the dielectric 30.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A retractable/extendable antenna for portable radio device, which is operable in an extended state and a retracted state;

the antenna comprising:

(a) a casing;

(b) a first antenna element attached retractably or extendably to the casing;

the first element being formed by a linear antenna element;

the first element being located outside the casing and fed with electric power to be active in the extended state;

the first element being located inside the casing and fed with no electric power to be inactive in the retracted state; and (c) a second antenna element connected mechanically to one end of the first element and disconnected electrically therefrom;

the second element being formed by a linear antenna element and shorter than the first element;

the second element being located outside the casing and fed with no electric power to be inactive in the extended state;

the second element being located outside the casing and fed with electric power to be active in the retracted state;

(d) the first and second antenna elements each directly supplied the electric power without connection to a third antenna element.

2. The antenna according to claim 1, further comprising a conductive support fixed to the casing;

wherein the first element is contacted with the support in the extended state and fed with electric power by way of the support, and the second element is contacted with the support in the retracted state and fed with electric power by way of the support;

and wherein the support, the first element, and an intervening dielectric constitute a first adjusting capacitor in the extended state while the support, the second element, and an intervening dielectric constitute a second adjusting capacitor in the retracted state.

3. The antenna according to claim 1, further comprising a conductive stopper fixed to bottom of the first element by way of a dielectric;

wherein the first element, the stopper, and the intervening dielectric constitute an adjusting capacitor in the extended state.

4. The antenna according to claim 1, further comprising a dielectric separator provided to mechanically connect the first element to the second element and electrically disconnect the first element from the second element;

wherein the second element, the casting, and the intervening separator constitute an adjusting capacitor in the retracted state.

5. The antenna according to claim 1, wherein the first element is designed for being electrically connected to a terminal matching circuit in the retracted state;

wherein the terminal matching circuit provides an adjusting reactance element in the retracted state.

6. The antenna according to claim 5, further comprising a dielectric separator provided to mechanically connect the first element to the second element and electrically disconnect the first element from the second element;

wherein the second element, the casing, and the intervening separator constitute an adjusting capacitor in the retracted state.

7. The antenna according to claim 1, further comprising a dielectric stopper fixed to the first element and a conductive piece fixed to a surface of the stopper;

wherein the first element, the piece, and the intervening stopper constitute an adjusting capacitor in the extended state.

8. A retractable/extendable antenna for portable radio device, which is operable in an extended state and a retracted state;

the antenna comprising:

(a) a casing;

(b) a first antenna element attached retractably or extendably to the casing;

the first element being formed by a linear antenna element;

the first element being located outside the casing and fed with electric power to be active in the extended state;

the first element being located inside the casing and inactive in the retracted state; and (c) a second antenna element connected mechanically to one end of the first element and connected electrically to the first element in both the retracted and extended state;

the second element being formed by a linear antenna element and shorter than the first element;

the second element being located outside the casing and fed with electric power to be active in the extended state;

the second element being located outside the casing and fed with electric power to be active in the retracted state.

9. The antenna according to claim 8, wherein the first element is integrated with the second element.

10. The antenna according to claim 8, wherein the first element is electrically connected to the second element by way of a conductive member;

and wherein the first and second elements are fed with electric power by way of the member in the retracted state.

11. The antenna according to claim 8, further comprising a conductive support fixed to the casing;

wherein the first element is contacted with the support in the extended state and fed with electric power byway of the support, and the second element is contacted with the support in the retracted state and fed with electric power by way of the support;

and wherein the support, the second element, and an intervening dielectric constitute an adjusting capacitor in the retracted state.

12. The antenna according to claim 8, further comprising a conductive stopper fixed to bottom of the first element by way of a dielectric;

wherein the first element, the stopper, and the intervening dielectric constitute an adjusting capacitor in the extended state.

13. The antenna according to claim 8, wherein the first element is designed for being electrically connected to a terminal matching circuit in the retracted state;

and wherein the terminal matching circuit provides an adjusting reactance element in the retracted state.

14. The antenna according to claim 8, further comprising a dielectric stopper fixed to the first element and a conductive piece fixed to a surface of the stopper;

wherein the first element, the piece, and the intervening stopper constitute an adjusting capacitor in the retracted state.

* * * * *